US007977389B2

(12) United States Patent
Strey et al.

(10) Patent No.: US 7,977,389 B2
(45) Date of Patent: Jul. 12, 2011

(54) MICROEMULSIONS AND USE THEREOF AS A FUEL

(75) Inventors: Reinhard Strey, Dormagen (DE); Axel Nawrath, Pulheim (DE); Thomas Sottmann, Köln (DE)

(73) Assignee: Universitat Zu Koln, Cologne (DE)

( * ) Notice: Subject to any disclaimer, the term of this patent is extended or adjusted under 35 U.S.C. 154(b) by 594 days.

(21) Appl. No.: 10/566,138

(22) PCT Filed: Jul. 29, 2004

(86) PCT No.: PCT/EP2004/051665

§ 371 (c)(1), (2), (4) Date: Aug. 14, 2006

(87) PCT Pub. No.: WO2005/012466

PCT Pub. Date: Feb. 10, 2005

(65) Prior Publication Data

US 2007/0028507 A1 Feb. 8, 2007

(30) Foreign Application Priority Data

Jul. 29, 2003 (DE) ..... 103 34 897

(51) Int. Cl.
*C09K 3/00* (2006.01)

(52) U.S. Cl. ..... 516/58

(58) Field of Classification Search ..... 516/58
See application file for complete search history.

(56) References Cited

U.S. PATENT DOCUMENTS

| | | | | |
|---|---|---|---|---|
| 6,017,368 | A * | 1/2000 | Steinmann | 44/302 |
| 2002/0088167 | A1* | 7/2002 | Filippini et al. | 44/301 |
| 2002/0120015 | A1* | 8/2002 | Dennis et al. | 514/772.3 |
| 2003/0037484 | A1* | 2/2003 | Steinmann | 44/387 |

FOREIGN PATENT DOCUMENTS

| | | | |
|---|---|---|---|
| WO | WO 03/064565 | A | 8/2003 |
| WO | WO 03/065479 | A | 8/2003 |

OTHER PUBLICATIONS

Jakobs et al., "Amphiphilic Block Copolymers as Efficiency Boosters for Microemulsions", Langmuir 1999, 15, 6707-6711.*

Jakobs B.et al; "Efficiency Boosting with Amphiphilic Block Copolymers—a New Approach to Microemulsion Formulations"; Tenside, Surfactants, Detergents, Carl Hanser Verlag, Munchen, Germany, vol. 37, No. 6, 2000, pp. 357-364.

Endo H, et al; "Amphiphilic block copolymers as efficiency boosters in microemulsions: a SANS investigation of the role of polymers"; Applied Physics A (Materials Science Processing); Springer-Verlag, Germany, vol. A74, 2002, pp. S-392-S395.

Endo H, et al; "Membrane decoration by amphiphilic block copolymers in bicontinuous microemulsions"; Physical Review Letters APS USA, vol. 85, No. 1, Jul. 3, 2000; pp. 102-105.

J.R. Kanicky et al; Chapter 11 Surface Chemistry in the Petroleum Industry; 2001, John Wiley & Sons, Ltd. Handbook of Applied Surface and Colloid Chemistry, pp. 251-267.

Gillberg et al., J. of Colloid and Interface Science 33:40-53 (1970).

Wennerström et al., Colloid and Surfaces A: Physicochemical and Engineering Aspects 123-124:13-26 (1997).

Paul et al., J. Dispersion Science and Technology 18(4):301-367 (1997).

* cited by examiner

*Primary Examiner* — Ling-Siu Choi
*Assistant Examiner* — Chun-Cheng Wang
(74) *Attorney, Agent, or Firm* — Norris McLaughlin & Marcus, P.A.

(57) ABSTRACT

The invention relates to bicontinuous microemulsions and to the use thereof as a fuel, combustion or heating fluid. Said fuels permit an increased efficiency of internal combustion systems and heating installations of any type and, simultaneously, a minimized emission of pollutants, associated with combustion, to be obtained.

17 Claims, 8 Drawing Sheets

MICROEMULSIONS AND USE THEREOF AS A FUEL

This application is a 371 of PCT/EP2004/051665, filed Jul. 29, 2004, which claims foreign priority benefit under 35 U.S.C. §119 of the German Patent Application No. 103 34 897.2 filed Jul. 29, 2003.

The present invention relates to microemulsions which have a characteristic nanostructure of alternating continuous hydrophilic and hydrophobic domains. Such microemulsions serve as fuels which allow combustion with unprecedented low noxious substances emission and high efficiency.

BACKGROUND OF THE INVENTION

The combustion of fossil fuels based on raw petroleum poses problems in many respects. The world oil consumption is currently around 3.5 billion tons, about 90% thereof being used as fuels. Automobile fuels, power plant fuels, ship fuels and aircraft fuels form the major part thereof.

However, when the consumption remains constant, the world's oil resources will last for only about another 50 to 100 years, so that there is a high need for more efficient combustion methods.

More efficient combustion methods are also required in order to reduce the emission of $CO_2$ as a product of combustion. In the earth's atmosphere, $CO_2$ reflects the heat radiation emitted from the ground. Therefore, the high emission of $CO_2$ is considered a main cause of the greenhouse effect.

Another problem in the combustion of conventional fuels is the emission of noxious substances, which cannot be eliminated completely even by novel fuel-injection and combustion techniques or fuel additives.

Just in the motorized traffic, the load on the air from noxious substances like nitrogen oxides ($NO_x$), carbon monoxide (CO), hydrocarbons (HC) and particulate matter (PM) and precursor substances, which adversely affect the ozone balance, causes great problems. These problems can be solved only partially by modern exhaust gas aftertreatment techniques, such as automobile exhaust catalysts. Thus, although diesel fuel can be combusted more efficiently as compared to other fuels, such combustion results in a considerable formation of particulate matter. For technical reasons, an exhaust gas aftertreatment for the removal of $NO_x$ is not employed in diesel vehicles currently.

Also, the load on the atmosphere from noxious substances emitted by aircrafts is an as yet unsolved problem.

For the more efficient use of fossil energy sources, improved combustion techniques, such as improved fuel injection in combustion engines, are being developed. However, improved combustion methods often result in an increased emission of noxious substances. Due to thermodynamic laws, the efficiency of combustion engines is enhanced as the combustion temperature increases. However, an increase of combustion temperature often results in an increased emission of noxious substances, especially $NO_x$.

One possibility for the simultaneous improvement of combustion efficiency and reduction of emission of noxious substances is the use of special fuels, especially fuels which consist of a mixture of aqueous and non-aqueous phases, such as water-in-oil (w/o) emulsions. Such fuels allow an efficient combustion process in spite of comparatively low combustion temperatures.

A central point in the use of these particular fuels is the positive effect of the addition of water on the combustion due to the steam engine effect of the evaporating water. This means that water is transferred from the liquid to the vapor state and thereby joins the combustion gases in driving the piston. Due to the evaporation enthalpy, the evaporation of the water reduces the temperature in the combustion chamber, whereby a reduction of the noxious substances $NO_x$ and CO, HC and PM ("particulate matter", soot) in the exhaust gases is achieved.

The use of emulsions of oil and water in various combustion processes has been tested many times. The main disadvantage of such emulsions is their instability, and moreover, their water content is not variable and very low.

Formulations which are described as kinetically stabilized microemulsions are known. Also, the use of thermodynamically stable microemulsions has been described before. These are non-optimum microemulsions (w/o) consisting of water-swollen micelles existing in the fuel. Thus, they are microemulsions comprising exactly one continuous phase. Therefore, the water content in the fuel microemulsions known so far is rather low and is often not more than 20%. Microemulsions with higher water contents have often high or expensive emulsifier fractions. Further, many formulations include high contents (up to 20%) of alcohols.

Most known water-fuel mixtures have only water-in-oil micelles as a microstructure and are not optimum bicontinuous microemulsions. In many inventions, there is a problem in that little water can be emulsified. In addition, for optimizing the combustion, a technology is needed for adjusting the water content of the mixture at will. If the composition of the known water-fuel mixtures is considered in more detail, they are often not water-fuel emulsions with alcohol additions, but rather alcohol-fuel emulsions with low additions of water. Often, the high fugacity of ethanol causes the additional problem that ethanol, but also other more volatile substances are increasingly driven out of the mixture and into the gas phase.

U.S. Pat. No. 4,744,796 describes water/fuel microemulsions with diesel fuel, gasoline, fuel oil and kerosine as the oil component that are stably one-phase and clear over a maximum broad range of temperatures of from −10° C. to +70° C. while showing a high salt tolerance. Their content of the aqueous component consisting of water and/or methanol is from 3 to 40%. As a cosurfactant, tert-butyl alcohol (TBA, 1-20%, with methanol up to 30%) is added to one or more cationic, anionic, amphoteric and non-ionic surfactants (2-20%). Betains with different carbon chain lengths (11-17) are employed as amphoteric surfactants, and ethoxylated alcohols ($C_iE_j$), alkylphenols and carboxylates are employed as non-ionic surfactants. Quaternary ammonium salts are used as cationic surfactants, and fatty acids are used as anionic surfactants. These water/fuel microemulsions are non-bicontinuous o/w microemulsions which are not optimal for this purpose. Further, TBA is used as an obligatory cosurfactant in this patent.

U.S. Pat. No. 4,158,551 describes an emulsion of gasoline, water and non-ionic surfactants in order to minimize exhaust gases harmful to the environment in the combustion. The mixture includes up to 22% of water and is stabilized by 1-3.5% of surfactants. The surfactants are essentially ethoxylated alkylphenols with 1.5-30 moles of ethylene oxide per mole of nonylphenol. However, such an emulsion is thermodynamically unstable.

U.S. Pat. No. 6,302,929 describes high-water fuels which are based on two-phase water-continuous (o/w) emulsion systems in contrast to most other known emulsions. As compared to pure hydrocarbons, these fuels have the advantage that they are not inflammable outside the combustion chamber. In the mixtures described, from 20 to 80% of water can be emulsified. Further, the emulsions contain from 2 to 20% of alcohols, low amounts (0.3-1%) on non-ionic surfactants ($C_iE_j$, alkylglucosides, Igepal CO-630), and minor proportions of polyorganosiloxanes. The fuel component is gasoline, kerosine, diesel fuel, synthetic and biological fuels, which can be combusted more effectively than the pure hydrocarbons. The high proportion of water decreases the combustion temperature so much that the emission of noxious substances is reduced (CO: −50%). However, the described preparation of the mixtures is difficult to perform, and the combustion composition probably varies widely in the application. In addition, in practice, the engines must be modified to a higher extent for two-phase mixtures ("rotary engines") as compared to one-phase mixtures.

EP 0 475 620 describes non-temperature-sensitive diesel fuel, gasoline and kerosine microemulsions and their low-pollutant combustion. The mixtures include up to 30% of water, which can be replaced partially or wholly by methanol, ethanol or propanol. In addition to a wide variety of additives (for example, ammonium nitrites, nitrates and halogenates as well as halogen acids and organic compounds) for improving the combustion parameters, a comprehensive selection of emulsifier systems is described which are employed as combinations of at least two different surfactants. Thus, in addition to many ionic surfactants ($C_8$-$C_{30}$ chains with and without branching/ring) with different head groups (including alkali metals, —$SO_3H$, —$NH_3$ and alkylated, alkanoylated, ethoxylated or sulfonated ammonium), a number of non-ionic surfactants (for example, $C_iE_j$, Igepals, ethoxylated alkylphenols) are also used. The classification is not by ionic and non-ionic, but by hydrophilic and lipophilic surfactants (phase condition $\underline{2}$ or $\overline{2}$ at T=20° C., $\Phi=\alpha=0.5$ and $\gamma=0.02$). In addition, a wide range of cosurfactants (medium-chain alcohols, glycol ethers and ethers) are employed. What is described is one-phase, transparent microemulsions. However, one-phase microemulsions with 2% of surfactant are optically turbid, and therefore, it can be assumed that the optically clear microemulsions must contain more than 10% of surfactant. Such mixtures with a low water/surfactant ratio are not sufficiently efficient for an economical application.

U.S. Pat. No. 5,669,938 describes one-phase w/o emulsions consisting of diesel fuel and 1-40% of water and surfactant for the reduction of noxious substances (CO, $NO_x$, HC, PM, soot). A key characteristic is the use of organic alkyl nitrates. Linear hydrocarbons having a chain length of from 5 to 10 carbon atoms as well as branched hydrocarbons, especially the 2-ethylhexyl residue, serve as alkyl residues.

U.S. Pat. No. 4,451,265 describes one-phase, clear fuel/water microemolsions which have high stabilities at low temperatures. In their non-elucidated microstructure, the existence of w/o micelles is assumed. The mixtures consist of diesel fuel (34-99%), water (0.1-6%), alcohol (0.5-42%) and a surfactant system (0.5-58%). As alcohols, which make up the vast majority of the aqueous phase ($\Psi_{eth}$=70-95%), mainly ethanol, but also methanol and propanol are used. The water proportion in the emulsion is limited to a maximum of 6%. Described are microemulsions with technical surfactants which have a hydrophilic N,N-dimethyl-ethanolamine head and a hydrophobic fatty acid residue with a carbon chain length of from 9 to 22 atoms, especially fatty acids from soybean.

U.S. Pat. No. 4,451,267 describes microemulsion fuels made from vegetable oils. Mainly soybean oil, but also many other oils, for example, rapeseed oil, are used as vegetable oils. The aqueous component of the low-water microemulsions mainly consists of methanol, ethanol or propanol ($\Psi_{eth}$=70-95%). Amines trialkylated with long-chain fatty acids are used as surfactants and supplemented by large amounts of butanol as a cosurfactant (about 20%). In this case too, w/o micelles are assumed as microstructures.

U.S. Pat. No. 4,002,435 describes w/o emulsions with gasoline which are stably mono-phase over a wide range of temperatures and are based on large proportions of alcohol (0.1-20%). As alcohols, methanol, ethanol and isopropanol are employed. The emulsions contain little water (0.1-10%) and a mixture or organic oleate, linolate and stearate salts, oleic acid as well as phenolated and ethoxylated fatty alcohols.

U.S. Pat. No. 4,599,088 describes gasoline emulsion fuels with 2-10% of alcohol, such as methanol, ethanol, isopropanol or TBA. However, the formulations contain only 0.1-0.5% of water. The mixtures include 0.1-3.0% of surfactants, which are exclusively non-ionic alkylphenols and $C_iE_j$ surfactants, where i=9-24, and j=6-10. The mixtures are referred to as w/o type one-phase microemulsions (micelles). However, little water can be dissolved therein. Higher additions of water result in a water excess phase in the fuel tank.

U.S. Pat. No. 5,104,418 describes microemulsion systems of water, diesel fuel, glycolipid (surfactant) and aliphatic alcohols (cosurfactant). The microemulsions are stably monophase from 0° C. to 80° C. The description comprises glycolipids of the form A-X-R, where the hydrophilic surfactant heads A may be glucose, mono-, di-, tri- and tetrasaccharides. As the hydrophobic residues R, saturated, mono- and polyunsaturated, linear and branched hydrocarbon chains having a carbon chain length of from 10 to 24 atoms are mentioned; they are linked with the surfactant head through the functional groups X=ether, ester, acetal and hemiacetal. The microemulsions are defined as a thermodynamically stable colloidal dispersion. In this case too, for large diesel fuel contents (60-90%), the water contents are very low, being 1-10%. In contrast, the cosurfactant content (Butanol, pentanol, hexanol) is very high, being 6.3-21%, and the glycolipid content is 1.7-9%. U.S. Pat. No. 5,259,851 describes similar water/fuel/glycolipid/cosurfactant microemulsions with the same glycolipids and similar mixing ratios. However, different cosurfactants are employed here, namely aliphatic diols, and in addition to diesel fuel, there are also employed gasoline, fuel oil, kerosine and other oils.

U.S. Pat. No. 4,465,494 and EP 0 058 605 describe microemulsions of water, fuel (including fuel oil), surfactant and additive (special alcohols and amines), which are stably monophase from −20° C. to +100° C. (in part only from −10° C. to +20° C.). In addition to 1-27% of alcohol (methanol, ethanol, isobutanol and ethyl-2-hexanol), these mixtures include only 1-10% of water. Benzyl amines and phenoxy-alkylated organic acid salts (counter ion: metal ion or organic base) of different carbon chain lengths are employed as surfactants. The microemulsions are efficient with a surfactant content of 1-10%. Further, in addition to a method for the preparation of the microemulsions, the reduction of emissions during their combustion is described. The emission of CO is reduced by 80%, and that of $NO_x$ by 75%, based on 100 kilometers driven, as compared to conventional fuels.

U.S. Pat. No. 6,017,368 describes microemulsions which contain water, fuel, anionic and non-ionic surfactants, unsaturated fatty acids, aliphatic alcohols and ethanol or methanol. They are water-in-oil micelles with a low water content of from 1 to 10%. These microemulsions are stable over a wide range of temperatures, have a low viscosity and have a reduced emission of noxious substances during combustion. Gasoline and fuel oil are employed as fuels in addition to diesel fuel. The content of water-soluble alcohols, being from 6 to 14%, is higher than the water content. The water-insoluble alcohols (from 1 to 10%) have a hydrocarbon chain length of from 5 to 9 atoms. The anionic surfactants employed (2 to 10%) are based on ammonium-neutralized unsaturated fatty acids, for example, from soybean oil. As non-ionic surfactants (1 to 5%), non-ethoxylated compounds are exclusively employed because ethoxylated compounds have poor combustion properties according to U.S. Pat. No. 6,017,368. Only 2,4,7,9-tetramethyl-5-decyne-4,7-diol is mentioned as a non-ionic surfactant.

EP 1 101 815 describes diesel fuel/water microemulsions which contain an emulsifier and an emulsifiable agent, especially sorbitan monooleate and nonylphenol ethoxylate. However, the water content is limited to a narrow range of concentrations (100-145 parts of water, based on 1000 parts of diesel fuel).

WO 00/31216 and EP 1 137 743 describe a diesel fuel composition consisting of diesel fuel, (water-containing) ethanol, a polymeric stabilization additive and optionally an alkyl ester of a fatty acid and/or an auxiliary solvent, such as s short-chain alkyl alcohol. However, the water content of the ethanol employed is at most 5% by weight, based on the amount of ethanol in the mixture.

DE 10003105, WO 01/55282 and EP 1 252 272 describe fuel-water emulsions in which an alkoxylated polyisobutene is used as the emulsifier. The emulsion preferably contains 10-25% of water and 0.2-10% by weight of emulsifier.

The water content in the water/fuel microemulsions known so far is low. It is often not more than 5 to 20%, less frequently up to 40%. Water/fuel microemulsions with higher water proportions can be found in very few descriptions, and with uneconomically high emulsifier contents. Further, many formulations include high contents (up to 20%) of alcohols (methanol, ethanol and in part also longer-chain alcohols).

Disadvantages of the described emulsions and methods are their low emulsion stability, the high content of emulsifier, which is cost-intensive, or an insufficient systematic knowledge on the phase behavior as well as mechanisms during combustion. However, these are a precondition for designing an optimum formulation for an optimum combustion.

Conventional water/fuel mixtures have water-in-oil micelles as microstructures and are not optimum bicontinuous microemulsions. Due to this fact, there is often a problem in that little water can be emulsified. For optimizing the combustion, the technology for freely adjusting the water content of the mixture is often lacking.

Some conventional water/fuel mixtures are not water/fuel emulsions with alcohol additions, but only alcohol/fuel emulsions with low additions of water. The high fugacity of ethanol causes the additional problem that ethanol, but also other more volatile substances are increasingly driven out of the mixture and into the gas phase.

SUMMARY OF THE INVENTION

Microemulsions have now been found which are optimum bicontinuous microemulsions, in contrast to known formulations. These microemulsions can be employed as hydrofuels, they have a characteristic nanostructure of alternating water and oil domains and prove to be fuels with unprecedented low noxious substances emission and high efficiency. Such microemulsions allow to mix water and conventional fuels in any ratio desired and are still thermodynamically stable.

The present invention relates to:

(1) a bicontinuous one-phase microemulsion at least consisting of an aqueous component (A), a hydrophobic component (B) and an amphiphilic component (C/D), wherein the microemulsion simultaneously comprises a continuous aqueous phase and a continuous hydrophobic phase, and the hydrophobic component (B) contains one or more substances which can be employed as a fuel;

(2) a preferred embodiment of (1), wherein said amphiphilic component contains at least one non-ionic surfactant (C);

(3) a preferred embodiment of (2), wherein said amphiphilic component further contains at least one ionic surfactant (D), preferably a sulfur-free ionic surfactant (D);

(4) the use of the microemulsion as defined in (1) to (3)

(i) as a fuel in combustion engines, preferably in reciprocating piston engines, rotating piston engines and turbine engines; and/or (ii) as a fuel in thrust engines, preferably in jet engines, turbine jet engines and rocket engines; and/or (iii) as a fuel in furnaces, preferably in heating installations and steam generation installations; and/or (iv) in ignition processes; and/or (v) in explosives; and (5) a method for the determination and optimization of microemulsions according to (1) to (3), comprising the steps of:

(i) determining the temperature variance and adjusting the temperature invariance of the one-phase microemulsion by adjusting the content of amphiphilic component (C/D); and (ii) adjusting the water-to-oil ratio within a range of the volume ratio of oil to water plus oil of from 4 to 96% by volume of the hydrophobic component (B).

The central point of the present invention is the efficient solubilization of water in conventional fuels, such as diesel fuel, biodiesel fuel, gasoline, premium gasoline, kerosine and fuel oil, using low concentrations of novel emulsifier mixtures of surfactants, cosurfactants and other additives which exhibit non-residue combustion. In contrast to existing emulsions, these mixtures are characterized by their thermodynamic stability, electric conductivity and one-phase property, which is found over wide ranges of temperature, at least from −30° C. to +95° C., preferably from −30° C. to +70° C. According to the invention, a clear reduction of emission of noxious substances is found in the combustion of the optimized hydrofuels. Thus, mainly the emission of $NO_x$, CO, incompletely burnt hydrocarbons (HC) and particulate matter is clearly reduced as compared to conventional fuels. A further aspect of the invention is the more efficient combustion of the hydrofuels as compared to conventional fuels.

Figure 1:
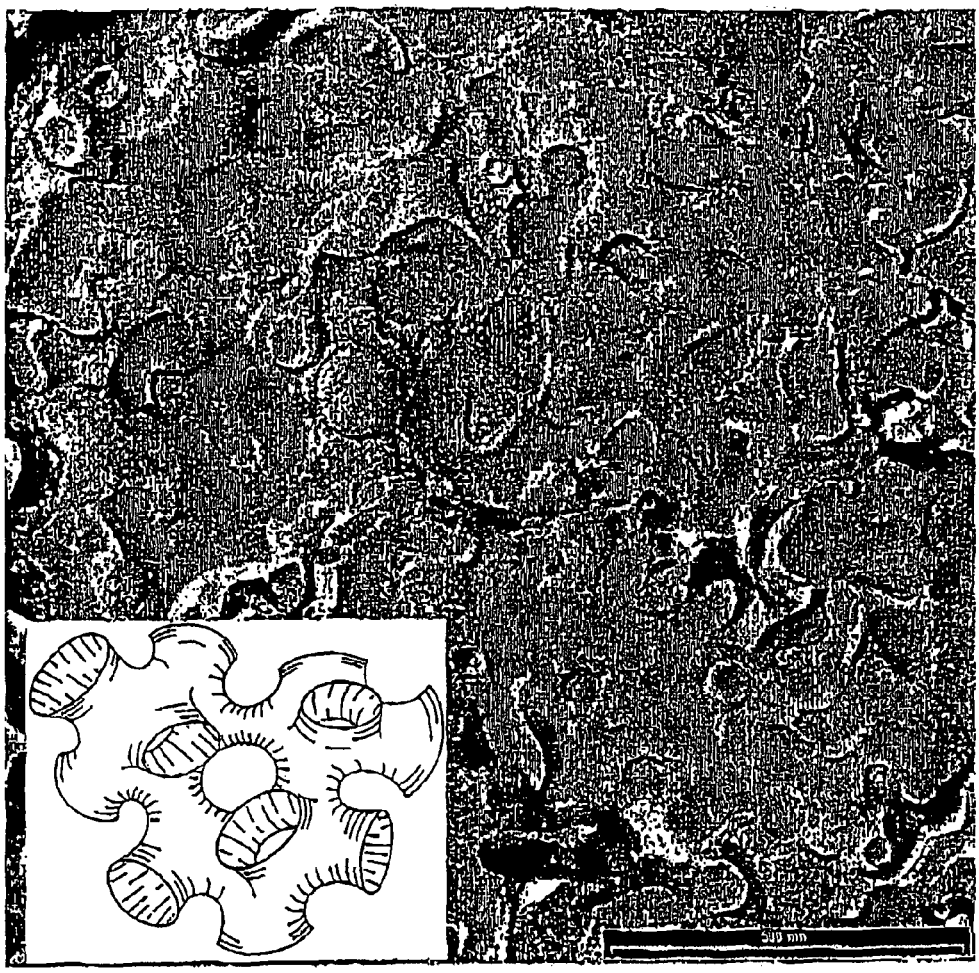
FIG. 1: Freeze fracture electron microphotograph of a bicontinuous microemulsion consisting of equal amounts of water and n-octane, surfactant content 5% by weight ($Cl_{12}E_5$). The drawing illustrates the three-dimensionally continuous form of the surfactant film which separates water and octane on a microscopic level.
Figure 2:
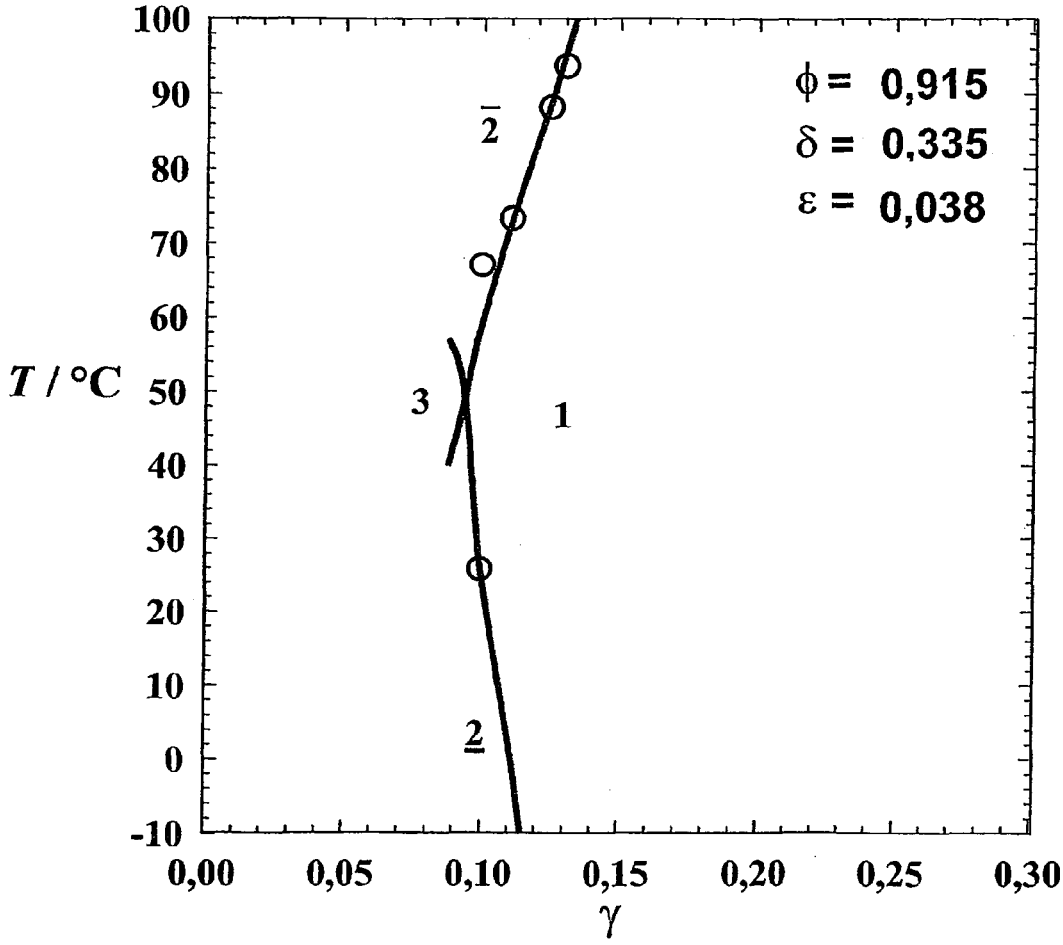
FIG. 2: Temperature invariance of a microemulsion consisting of water (A), diesel fuel (B), Lutensol® TO5, Lutensite® A-BO (AOT) and ammonium carbonate (E). The diesel fuel proportion Φ was 91.5% by volume, based on the sum of volumes of water and diesel fuel. The ratio of (D) to (C+D) was $\delta$=0.335, and the ratio of (E) to (A+E) was $\epsilon$=0.038 (similar to composition K-10, Ex. 2). Domain "3": domain in which three phases coexist (water excess phase, bicontinuous phase and oil excess phase); domains "2": domains in which 2 segregated phases coexist; domain "1": domain in which a one-phase microemulsion exists (bicontinuous phase); x axis: ratio γ of (C/D) to the total microemulsion in % by weight, y axis: temperature T in ° C.
Figure 3A:
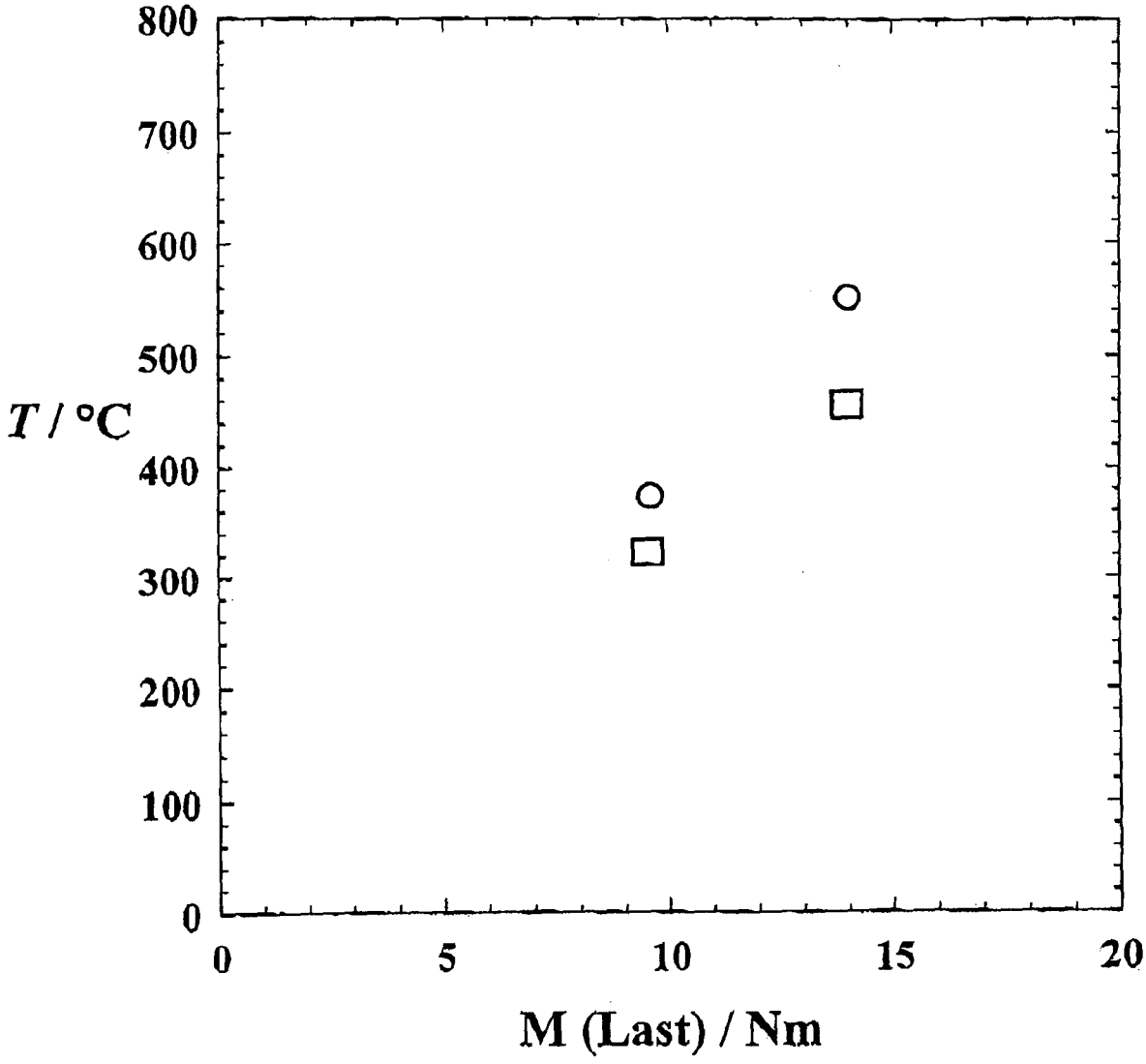
FIG. 3: Results of the combustion experiments on engine test bench I (cf. Ex. 10A). Mixture K-1 of components was measured in the preferred composition (Ex. 2).
Figure 3B:
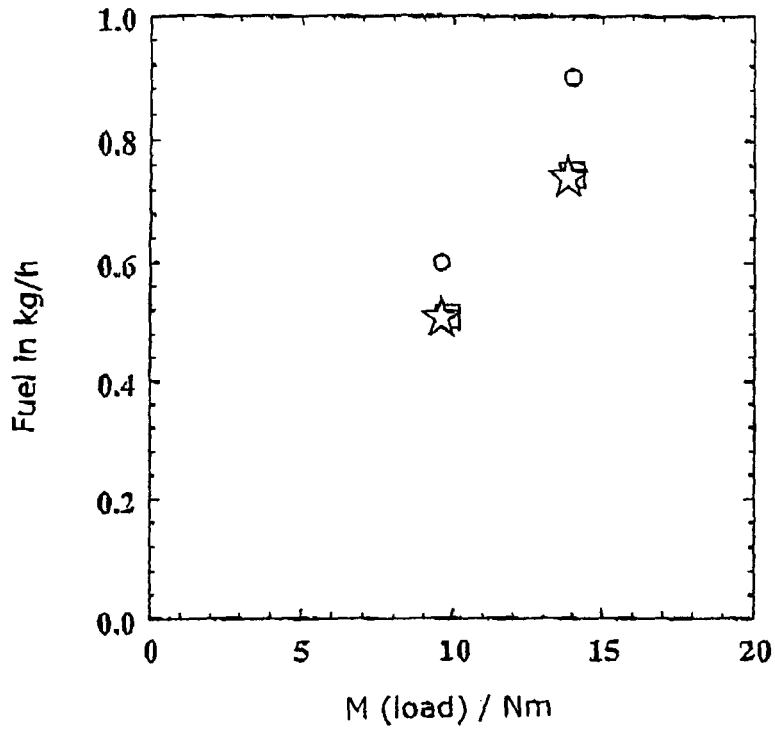
Figure 3C:
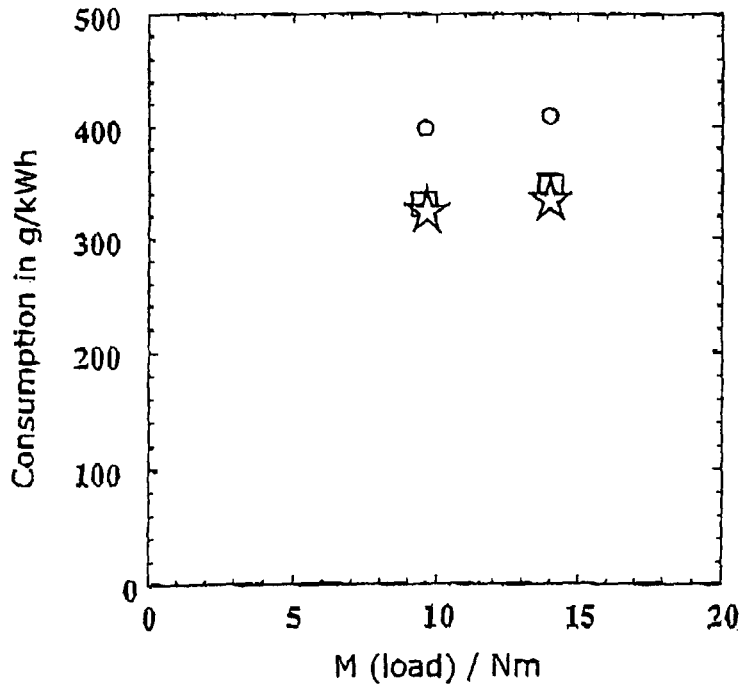
Figure 3D:
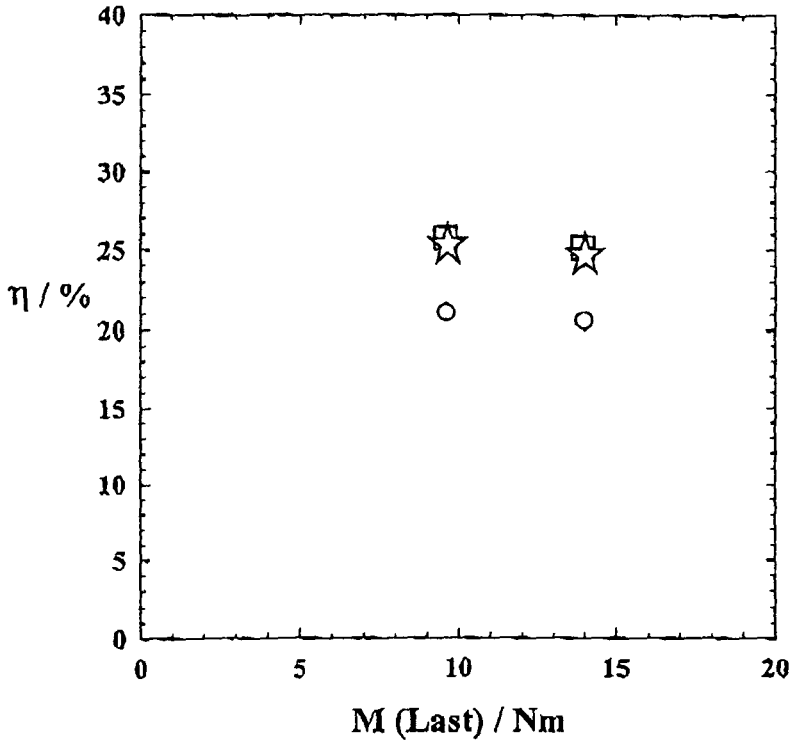
Figure 3E:
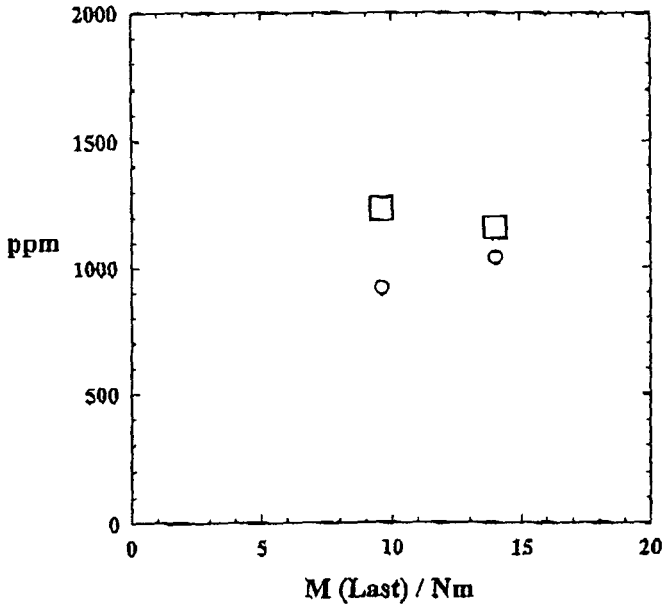
Figure 3F:
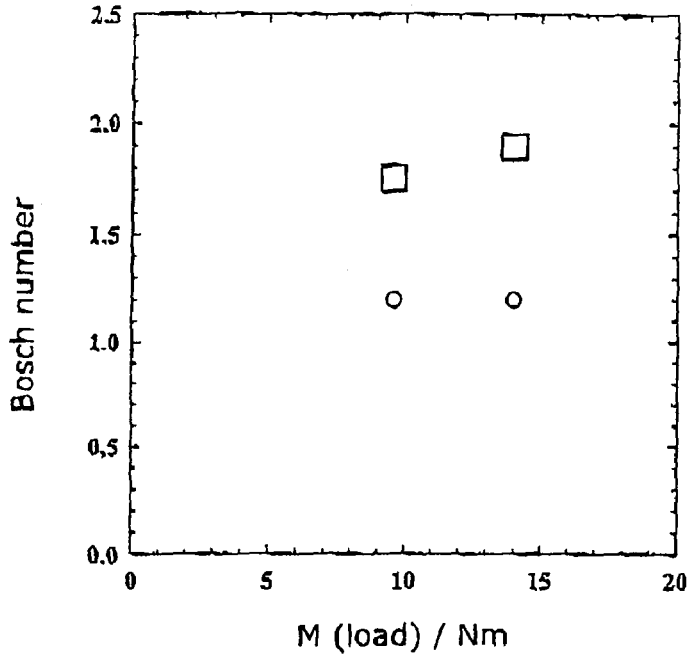
Figure 4A:
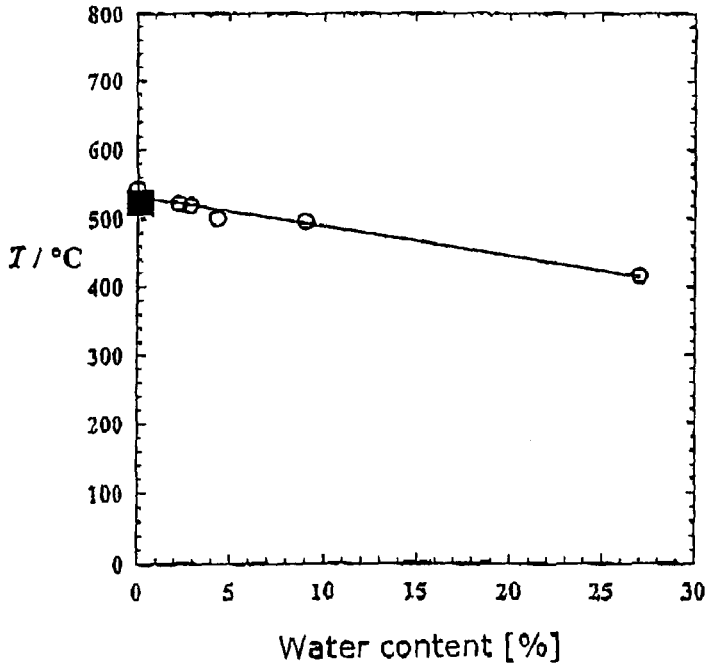
Figure 4B:
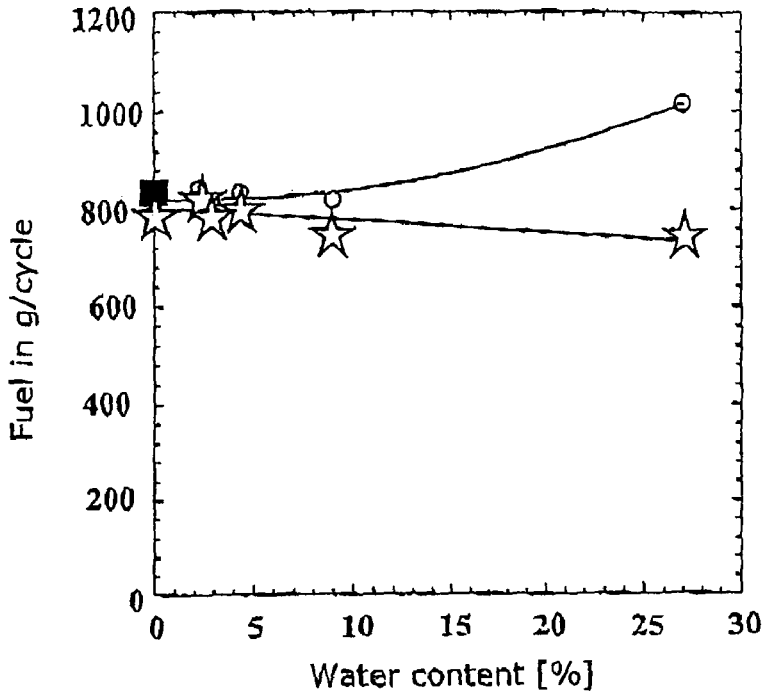
Figure 4C:
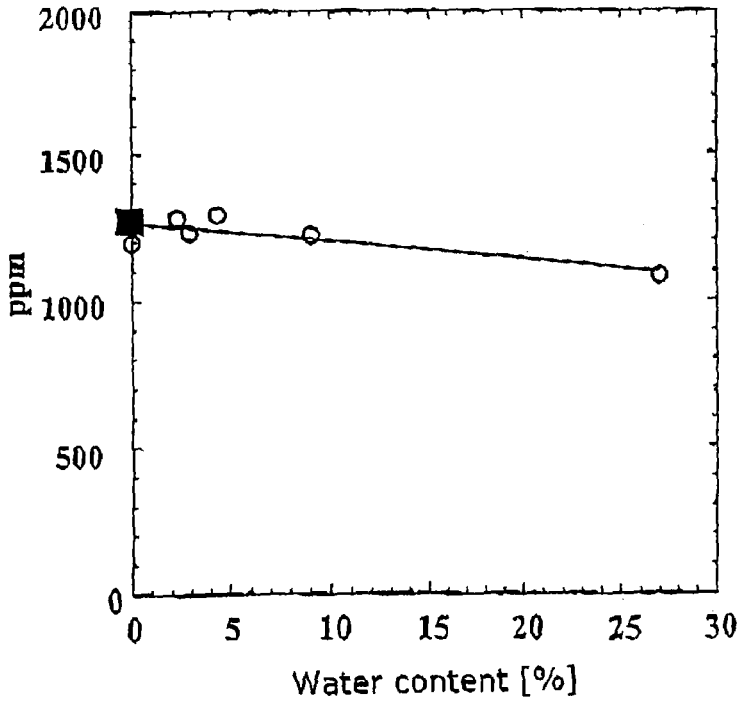
Figure 4D:
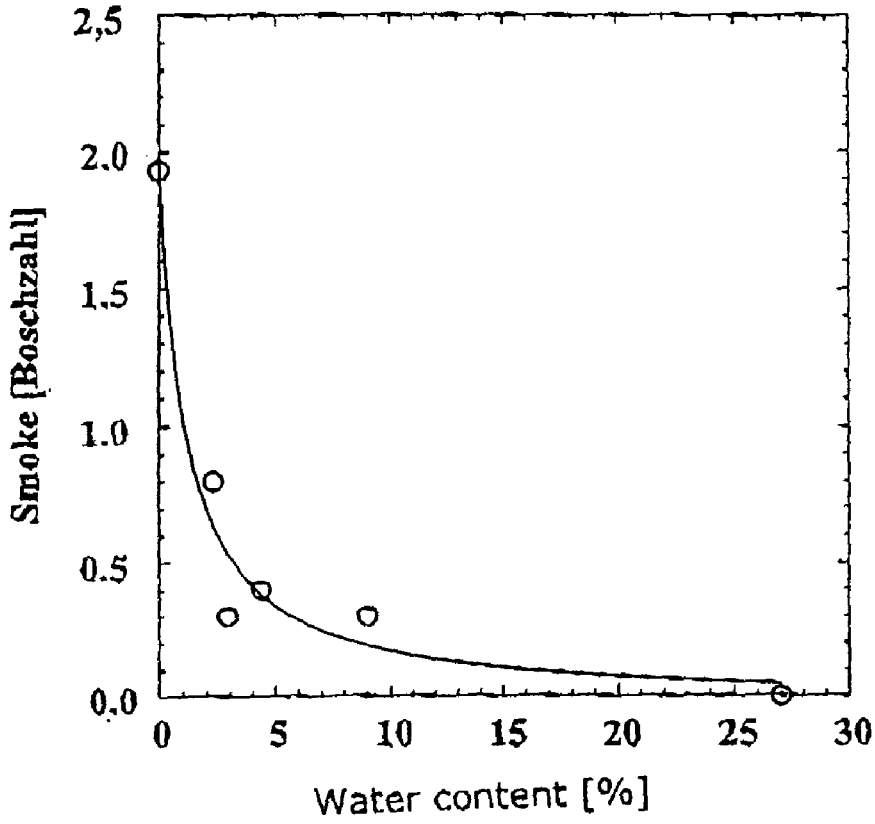

(a) exhaust gas temperature
(b) fuel consumption in kg/h
(c) fuel consumption in g/kWh
(d) efficiency η
(e) $NO_x$ content of the exhaust gas
(f) particulate matter (gray values) in FSN (filter smoke numbers) open circles (○): microemulsion; open squares (□): reference diesel fuel; open asterisks (☆): microemulsion, based on combustible components (without water).

FIG. 4: Results of the combustion experiments on engine test bench II (cf. Ex. 10B). Microemulsions consisting of water (A), diesel fuel (B), Lutensol® TO5 (C), either Lutensite® A-BO (AOT) or AOT (see Ex. 10B), and ammonium carbonate (E) were measured.

The samples in detail: (1) 8.70% by weight of water, γ=0.13; 4.350/% by weight of water, γ=0.13; (3) 2.87% by weight of water, γ=0.13; (4) 2.25% by weight of water, γ=0.10; (5) reference diesel fuel; in addition, various measuring points were measured in the range of 9-27% of water, γ=0.10, of which some are represented here. Detailed information relating to the samples can be found in Example 10B.
(a) exhaust gas temperature
(b) fuel consumption (MVEG; European standardized cycle in which a simulated path, e.g., city/country etc., is driven for about 20 min according to EU Direction 93/116/EC)
(c) $NO_x$ content of the exhaust gas
(d) particulate matter (gray values) in FSN Legend see FIG. 3; solid square (■): only surfactant in the fuel (no microemulsion).

DETAILED DESCRIPTION OF THE INVENTION

In the following statements, a distinction is made between emulsions and microemulsions.

"Emulsions" within the meaning of the present invention means liquid dispersions of water in oil which are stabilized by the presence of an emulsifier. Their preparation process is characterized by extremely high shear and an interfacial tension within a range of from 1 to 10 mN/m.

"Microemulsions" spontaneously form from the components upon slight stirring, preferably from an aqueous component, a hydrophobic component and at least one amphiphilic component and optionally further additives. They are nanostructured mixtures in which the water-oil contact is optimally shielded, with interfacial tensions within a range of from $10^{-4}$ to $10^{-1}$ mN/m.

In the present application text, "bicontinuous" means that there is a mixture according to the invention consisting of an aqueous and a hydrophobic phase which are separated from each other by an amphiphilic film on a microscopic level. Thus, this is a structure comprising two continuous domains, namely an aqueous and a hydrophobic domain.

Synonymously with the also employed term "hydrophilic component" and the word component "water" in word combinations which comprise the component "water-oil", the term "aqueous component" means water and water-soluble liquids or liquids which are completely miscible with water, especially water and short-chain organic alcohols, such as ethanol, methanol, n-propanol and isopropanol, butanol, ethylene glycol, propylene glycol, glycerol.

Synonymously with the also employed term "fuel", "oil" and the word component "oil" in word combinations which comprise the component "water-oil", the term "hydrophobic component" means hydrophobic liquids or liquids which are miscible with hydrophobic liquids, especially fuels based on fossil fuels and fuels recovered from renewable resources, more particularly diesel fuel, biodiesel fuel (rapeseed methyl ester), gasoline, premium gasoline, kerosine, bunker C oil and bio-oils (native oils, e.g., rapeseed oil, soybean oil etc.).

The term "amphiphilic component" comprises non-ionic and ionic surfactants, cosurfactants and other amphiphilic compounds as further specified under groups C and D. The terms "emulsifier" and "surfactant", which are also employed in the following text, are to be understood as synonyms with "amphiphilic component" unless further specified.

"Alkyl derivatives" and "alkyl residues" (synonymous with the word component "alkyl", such as in "polyalkylglucoside") within the meaning of the present invention include linear and branched saturated, mono- or polyunsaturated aliphatic hydrocarbyl chains, aliphatic alcohols, fatty alcohols, oxo alcohols or carboxylic acids, preferably aliphatic alcohols, fatty alcohols or oxo alcohols.

Thermodynamically stable one-phase mixtures of an aqueous component (A), a hydrophobic component (B) and an emulsifier component (C/D) have been found in which the volume ratio of oil to water plus oil can be adjusted freely within a broad range and the water content is variable. They have a bicontinuous microstructure, a low water/oil interfacial tension and electric conductivity and will burn more completely than the corresponding pure oil components.

With a low emulsifier content, the mixtures are stable through a wide range of temperatures, preferably from −30° C. to +95° C., more preferably from −30° C. to +70° C., even more preferably from 0° C. to +70° C. The mixtures may contain additives (E).

The content of the amphiphilic component (C/D) in the microemulsions according to the invention is from 0.5 to 20% by weight, preferably from 0.5 to 15% by weight, more preferably from 1 to 8% by weight, even more preferably from 1 to 5% by weight.

It is the object of the invention to provide optimized and clean fuels which can be burnt with air as efficiently and completely as possible in terms of the provided hydrocarbon content, preferably to form exclusively water and carbon dioxide. The emissions of $NO_x$, CO, incompletely burnt hydrocarbons (HC) and particulate matter (PM) are to be suppressed as far as possible, and the fuel consumption reduced.

According to the invention, this object is achieved by employing bicontinuous optimum microemulsions as the fuel and by adding emulsifier systems to the mixture which are adapted to each oil respectively and consist of at least one non-ionic surfactant, preferably in admixture with at least one ionic surfactant, more preferably in the presence of cosurfactants (longer-chain alcohols, amphiphilic block copolymers etc.).

The microemulsions according to embodiment (1) are thermodynamically stable one-phase microemulsions which preferably consist of water, technical oils and technical emulsifier mixtures.

As oils, there are used diesel fuel, biodiesel fuel, bio-oil, gasoline, premium gasoline, kerosine and/or fuel oil with water in a volume ratio of oil to water plus oil of ϕ=0.04-0.99, preferably ϕ=0.04-0.96.

The thermodynamic stability of the microemulsions according to the invention is achieved by emulsifier systems which are respectively adapted to each oil and preferably consist of non-ionic and ionic surfactants and cosurfactants, e.g., longer-chain alcohols, amphiphilic block copolymers etc. In addition to their efficiency, i.e., their low mass contents, the surfactants employed have the advantage to burn without additional emissions of noxious substances.

Optionally, oil-insoluble components, e.g., salts, glycerol, methanol and other cosolvents, which serve for improving the combustion are added to the water.

According to the invention, the most favorable water content is respectively adjusted for each oil in order to burn the oils as microemulsions in an optimal way in terms of emission of noxious substances and energy yield. For a minimum use of surfactants, optimum bicontinuous and conductible microemulsions for each water-to oil ratio are formulated. The composition of the microemulsion is selected to remain stably one-phase from −30° C. to +95° C., more preferably from −30° C. to +70° C., even more preferably from 0° C. to +70° C.

The microemulsions according to embodiment (2) consist of an aqueous component (A), a hydrophobic component (B) and an amphiphilic component (C/D; synonymous with emulsifier mixture) consisting of one or more non-ionic surfactants (C) which may additionally contain ionic surfactants (D) and which preferably contains at least one ionic surfactant (D) (embodiment (3)). Optionally, salts and additives (E) may be added to the aqueous component (A).

The aqueous component (A) of the microemulsions according to (1) consists of water to which one or more water-soluble alcohols may optionally be added, preferably from 0 to 50% by weight (based on A) of methanol, ethanol and/or bioethanol, from 0 to 40% by weight of propanol and/or tert-butyl alcohol, from 0 to 80% by weight of glycerol and/or ethylene glycol. Particularly preferred is the addition of one or more water-soluble alcohols in concentrations of the individual alcohols of from 0 to 40% by weight (based on A), even more preferably in concentrations of the individual alcohols of from 0 to 20% by weight. The total concentration of the alcohols in A is preferably from 0 to 90% by weight, more preferably from 0 to 30% by weight, even more preferably from 0 to 20% by weight.

The hydrophobic component (B) of the microemulsions according to embodiment (1) consists of one or more of substances selected from diesel fuel, biodiesel fuel (rapeseed methyl ester), gasoline, premium gasoline, kerosine, bunker C oil and bio-oils (native oils, e.g., rapeseed oil, soybean oil etc.). Mixtures of these substances in any mixing ratios can be employed as component (B). Diesel fuel or a mixture of diesel fuel, gasoline or premium gasoline on the one hand with bio-oil and/or biodiesel fuel on the other hand in any mixing ratios is preferably employed. Even more preferred is diesel fuel or a mixture of diesel fuel and biodiesel fuel or bio-oil.

The non-ionic surfactants (C), ionic surfactants (D) and salts and additives (E) may be employed in pure or technical grade, preferably in technical grade.

Non-ionic surfactants (C) in embodiment (1) and (2) are selected from one or more of the groups of linear or branched non-ionic surfactants (C-1), surfactants with a core structure, such as sugar surfactants (C-2), cosurfactants (C-3) and so-called "efficiency boosters" (C-4), preferably from the groups (C-1) and (C-2), more preferably from group (C-1), even more preferably from polyethoxylated and polypropoxylated alkyl derivatives of group (C-1). Particularly preferred are sulfur-free non-ionic surfactants (C).

Said group of linear or branched non-ionic surfactants (C-1) includes polyethoxylated alkyl derivatives ($C_iE_j$) and polypropoxylated alkyl derivatives ($C_iP_j$), soybean lecithin, oleic acid glycerol ester, alkylphenol ethoxylates ($C_iPhE_j$), mono- or polyalkylated polyethylene glycerides (PEG) and polypropylene glycols (PPG), organic phosphate esters, phospholipids and ethoxylated triglycerides. $C_iE_j$ and $C_iP_j$ have carbon chain lengths of i=4-30, and hydrophilic moieties j=1-20, preferably i=8-24 and j=3-16, more preferably i=10-20 and j=3-10. The alkyl derivatives within the meaning of the present invention contained in $C_iE_j$ and $C_iP_j$ (definition see above) are preferably linear and branched saturated, mono- or polyunsaturated fatty alcohols or oxo alcohols. $C_iPhE_j$ have carbon chain lengths of i=4-20 and hydrophilic moieties j=1-30, preferably i=8-16 and j=4-20, more preferably i=10-16 and j=10-18. All PEGs and PPGs have carbon chain lengths with i=4-30 carbon atoms, preferably i=10-24, and further, monoalkyl PEGs or PPGs have j=1-20 hydrophilic moieties, preferably j=4-16, dialkyl PEGs and trialkyl PEGs or PPGs have j=1-30 hydrophilic moieties, preferably j=6-22, and polyalkyl PEGs or PPGs have j=1-40 hydrophilic moieties, preferably j=8-32. Of the PEGs, even more preferred are PEG 300 dilaurate, PEG 400 distearate, PEG 200 distearate and PEG 30 dipoly-hydroxystearate. Phospholipids contain carbon chains having a length of i=4-30 carbon atoms, preferably i=8-24, more preferably i=12-20. Even more preferably employed phospholipids are prepared from technical fatty acids or phospholipids and/or contain naturally occurring fatty acids with carbon chain lengths of i=12-20.

The group of surfactants with a core structure, such as sugar surfactants (C-2), includes mono- and polyalkylglycosides ($C_iZ_j$), especially alkylglucosides ($C_iG_j$), (poly)alkylsorbitans ($C_iS_j$), alkylmaltosides ($C_iM_j$), alkyllactosides and their ethoxylated and propoxylated derivatives. The carbon chain length in the alkyl residues of these compounds is i=4-30, preferably i=8-24, more preferably i=12-20. They contain j=1-10 core moieties, preferably j=2-8 moieties, and are optionally derivatized with 1-40, preferably 4-20, ethylene oxide moieties or propylene oxide moieties. The alkyl residues in the alkylglycosides within the meaning of the present invention (definition see above) are preferably linear and branched, saturated, mono- or polyunsaturated carboxylic acids, more preferably natural fatty acids. Particularly preferred compounds from (C-2) are sorbitan fatty acid esters, more particularly sorbitan monooleate, sorbitan trioleate, sorbitan monolaurate, sorbitan monopalmitate, sorbitan monostearate, sorbitan tristearate, sorbitan monomyristate, sorbitan monococoate (sorbitan esterified with a mixture of fatty acids from cocoa beans).

Cosurfactants (C-3) within the meaning of the present invention are linear and branched, saturated, mono- or polyunsaturated aliphatic alcohols, polyhydric alcohols (especially diols), fatty alcohols and oxo alcohols with a carbon chain length of i=4-30, preferably i=4-25, more preferably i=8-20. Even more preferred are cosurfactants which consist of technical grade fatty alcohols.

Efficiency boosters (C-4) are amphiphilic block copolymers consisting of at least one hydrophobic and at least one hydrophilic block, preferably block copolymers of the form A-B, more preferably A-B block copolymers in which A is polyethylene and B is polyethylene oxide.

Ionic surfactants (D) according to embodiment (1) include alkyethanolamines and their salts, alkyldiethanolamines and their salts, alkylamines and their salts, carboxylic acids and their salts, alkyl sulfates and alkyl sulfosuccinates. As alkyl residues according to the invention (definition see above), there may be preferably used linear and branched, saturated, mono- or polyunsaturated aliphatic compounds, especially alkyl chains, aliphatic alcohols, fatty alcohols, oxo alcohols and carboxylic acids with carbon chain lengths of i=3-30, preferably i=4-24, more preferably i=12-20. The amino groups of the alkylamines, alkylethanolamines and alkyldiethanolamines may be substituted with one, two or three (three only with alkylamines, not with alkyethanolamines) alkyl residues according to the invention and optionally additionally with short-chain alkyl residues, preferably methyl, ethyl, propyl and butyl. Also possible is the use of quaternary ammonium salts which are alkyltri(short chain alkyl)ammonium salts or dialkyl(short chain alkyl)ammonium salts and whose counter ions are inorganic or organic anions, preferably selected from OH, Cl, Br, $HCO_3$, $CO_3$, $NO_2$, $NO_3$, acetate, oxalate, propionate. Diamines derived from the above mentioned amines which are bridged through a carbon chain of i=2-10 carbon atoms and their salts may also be employed.

All amine and ammonium surfactants may also be ethoxylated with j=1 to 30 ethylene oxide moieties (bivalent surfactants).

Another class of compounds within the ionic surfactants (D) are the salts of fatty acids, the fatty acids having chain lengths of i=3-30, preferably i=8-26, more preferably i=12-20. As cations, ammonium ions or alkali metal ions are employed, preferably ammonium ions or $Li^+$, $Na^+$, $K^+$, more preferably ammonium ions. Preferred fatty acid anions are oleate, stearate, palmitate, myristate, laurate and cocoate.

Also, free carboxylic acids with a chain length of i=4-30, preferably i=8-26, more preferably i=12-20, may be employed as component (D), wherein the carboxylic acid may be linear or aromatic, branched or unbranched, saturated, mono- or polyunsaturated. Preferred are carboxylic acids of natural origin, i.e., natural fatty acids (such as oleic acid), citric acid, salicylic acid etc. Salts of the carboxylic acids may also be employed, wherein ammonium ions, tetra(short chain alkyl)ammonium ions, quaternary hydroxylamines or alkali metal cations may also be used. For application as a fuel, it is particularly preferred that the ionic surfactants (D) are sulfur-free. As the sole sulfur-containing members of ionic surfactants (D), sodium alkylsulfates or sodium bisalkyl sulfosuccinates with an alkyl residue as defined above and chain lengths of i=6-20 can be used, more preferably bis(2-ethylhexyl) sulfosuccinate (AOT).

Preferred as ionic surfactants (D) are alkylamines as well as carboxylic acids and their salts, more preferably fatty acids and alkylamines with 12-20 carbon atoms.

The group of salts and additives (E) includes one or more compounds selected from non-halide salts (E-1), halides (E-2) and additives (E-3). The content of additives (E) in the total microemulsion is 0-4% by weight, based on the total microemulsion, preferably 0.01-2.5% by weight, more preferably 0.05-1.5% by weight, even more preferably 0.05-1.2% by weight.

Said group of non-halide salts (E-1) comprises carbonates, hydrogencarbonates, acetates, benzoates, oxalates, propionates, citrates, formates, nitrates and nitrites and other water-soluble non-halides. As cations in salts of group (E-1), alkali and alkaline earth ions as well as ammonium ions are used, preferably $Li^+$, $Na^+$, $K^+$, $Ca^{2+}$ and $NH_{4+}$. Preferred compounds from group (E-1) are the ammonium salts. The content of compounds of group (E-1) in the aqueous component A is 0-50% by weight, preferably 0-20% by weight, more preferably 0.01-10% by weight, even more preferably 0.01-6% by weight.

The group of halides (E-2) comprises all water-soluble halides, preferably chlorides, bromides and iodides, of the alkali metals and ammonium ion. In the case of ammonium halides, especially $NH_4Cl$, the proportion of the aqueous component (A) is from 0 to 50% by weight, preferably from 0 to 20% by weight, more preferably from 0 to 10% by weight, even more preferably from 0.1 to 5% by weight. In the case of all other halides, this proportion is from 0 to 10% by weight, preferably from 0.1 to 8% by weight, more preferably from 0.1 to 4% by weight.

The additives (E-3) comprise urea and its derivatives as well as other water-soluble, non-ionic additives. They may be employed in proportions of 0-25% by weight of component A, preferably 0.5-15% by weight, more preferably 0.5-10% by weight.

Component (E) is also preferably sulfur-free.

The mixing ratios in the microemulsion according to embodiment (1) are calculated as follows, wherein always one or more components from groups (A), (B), (C), (D) and (E), if contained in the mixtures, may be present:

The components from (E) are calculated as belonging to the proportion of (A).

The ratio of (A(+E)) to (B) is $$\alpha=B/(A(+E)+B)$$

where $\alpha$=0.04-0.99, preferably $\alpha$=0.45-0.99, more preferably $\alpha$=0.45-0.90, even more preferably $\alpha$=0.60-0.90.

The ratio of the amphiphilic component (sum of C plus D) to the total mixture is calculated from $$\gamma=(C+D)/(A(+E)+B+C+D)$$

where $\gamma$=0.005-0.20, preferably $\gamma$=0.005-0.15, more preferably $\gamma$=0.01-0.08, even more preferably y=0.01-0.05.

In those cases where an ionic surfactant from group (D) is contained in the mixture (i.e., the content of D is not zero):

$$\delta=D/(C+D)$$

where $\delta$=0.05-0.95, preferably $\delta$=0.10-0.50, more preferably $\delta$=0.20-0.40, even more preferably $\delta$=0.25-0.35.

Especially for those mixtures in which compounds from group (C-2) are contained in the amphiphilic component, the ratio of (C-2) to $C_{total}$ is:

$$\delta=(C\text{-}2)/C_{total}$$

where $\delta$=0.00-0.85, preferably $\delta$=0.10-0.60, more preferably $\delta$=0.20-0.55, even more preferably $\delta$=0.35-0.55.

Especially for those mixtures in which only compounds from groups (C-1) and (C-2) are contained as amphiphilic components, the ratio of (C-2) to (C-1) is preferably:

$$\delta=(C\text{-}2)/(C\text{-}1)+(C\text{-}2)$$

where $\delta$=0.00-0.80, preferably $\delta$=0.10-0.60, more preferably $\delta$=0.15-0.50.

Especially for those mixtures in which only compounds from groups (C-2) and (C-3) are contained as amphiphilic components, the ratio of (C-3) to (C-2) is preferably:

$$\delta=(C\text{-}3)/(C\text{-}2)+(C\text{-}3)$$

where $\delta$=0.00-0.40, preferably $\delta$=0.00-0.20, more preferably $\delta$=0.05-0.20.

Especially for those mixtures in which only compounds from group (C-4) are contained as amphiphilic components, the ratio of (C-4) to $C_{total}$ is:

$$\delta=(C\text{-}4)/C_{total}$$

where $\delta$=0.00-0.20, preferably $\delta$=0.00-0.10, more preferably $\delta$=0.01-0.10.

Especially for those mixtures in which compounds from group (E) are contained, the ratio of (E) to (A+E) is:

$$\epsilon=(E)/(A+E)$$

where $\epsilon$=0.00-0.50, preferably $\epsilon$=0.00-0.20, more preferably $\epsilon$=0-0.10.

The formulation and optimization of fuel microemulsions according to embodiment (5) comprises the following steps:

1. Preparing a microemulsion from water (A), conventional fuel (B) and non-ionic surfactant (C), preferably $C_iE_j$, with $\phi$=0.5 with pure surfactants or suitable technical surfactant mixtures.
2. Replacing the pure surfactants by suitable technical surfactant mixtures.
3. Adding additives (E) and optimizing the efficiency by efficiency boosters (C-4).
4. Adjusting the temperature invariance of the one-phase microemulsion by mixing from technical ionic (D) and non-ionic (C) surfactants.
5. Adapting the salt content (E).
6. Adjusting the water-to-oil ratio within a range of $\phi$=0.04-0.99, preferably $\phi$=0.04-0.96.
7. Establishing the optimum water-to-oil ratio by combustion, followed by reiterating the optimization, especially by adding further additives.

The order of the formulation steps can be varied, and in particular, the adding of the additives (E) to (A) can be performed already in the first step (cf. Ex. 1), and optionally, it may also be performed reiteratively.

The bicontinuity and the sponge structure of the microemulsions according to (1) can be detected by the high electric conductivity of the high-oil microemulsions, by electron microscopy, neutron-scattering experiments and by NMR self-diffusion measurements. The microscopic structure of a bicontinuous microemulsion according to the invention consisting of equal amounts of water and n-octane at a surfactant ($C_{12}E_5$) content of 5% is shown in FIG. 1. This Figure illustrates the three-dimensionally continuous form of the surfactant film which separates water from oil on a microscopic level.

Optimum microemulsions are characterized in that, when further water or oil is added, it will segregate as an excess phase. Thus, optimum microemulsions are maximally swollen with water and oil, and their surfactant content cannot be reduced further. The microemulsions according to the invention include water, mixtures of hydrocarbons, emulsifier mixtures and optionally cosurfactants and additives, such as anticorrosives or preservatives.

The emulsifier mixtures (C/D) of non-ionic and ionic surfactants are optionally based on renewable resources. For each oil, they are adjusted in such a way that temperature-invariant one-phase domains exist from −30° C. to +95° C., preferably from −30° C. to +70° C.

For the use of ionic surfactants, some salt content in the water is useful. Employed are combustible inorganic salts, such as ammonium carbonates, ammonium acetates and ammonium nitrates, which at the same time reduce the emission of noxious substances. Low-temperature stability is achieved with glycerol, ethanol and/or further additives. The addition of short-chain alcohols (methanol, ethanol, propanol) in fuel microemulsions is advantageous because the alcohol will become enriched at the interface between the water and fuel domains due to its surface activity. On the one hand, this reduces the vapor pressure of the alcohol, and on the other hand, the alcohol present at the interface does not cause an increase of the vapor pressure of volatile components, such as benzene and other aromatics.

The thus obtained mixtures are optimized with respect to their emulsifier content to the extent that water and conventional fuels can be mixed in a thermodynamically stable way with an emulsifier content of less than 5%. The surfactants are characterized by being combustible completely and without residues.

According to the invention, continuous water and oil domains are separated in the microemulsions by an amphiphilic film consisting of the emulsifier mixture. One property of these bicontinuously structured microemulsion fuels to be pointed out is their good electric conductivity. Thus, measuring the latter is a simple method for establishing bicontinuity. The electric conductivity offers new possible ignition and dispersion methods by applying high voltages with a correspondingly resulting high current density.

The optimum microemulsions according to the invention are characterized by their special emulsifier mixtures (see above) and the thus achieved solubilization efficiency. Thus, conventional fuels and water can be mixed in a thermodynamically stable way with an emulsifier content of clearly less than 5%.

On a microscopic level, this high efficiency leads to the formation of a unitary microstructure of water and fuel domains on the order of 100 nm which allows optimum combustion conditions to be adjusted. Due to the strong light scattering, the novel microemulsion fuels appear optically turbid like emulsions. Nevertheless, they are one-phase, thermodynamically stable microemulsions.

The property that the bicontinuous microstructuring of the microemulsion fuels according to the invention correlates with the presence of very low interfacial tensions between water and conventional fuel on the order of $10^{-4}$ $mNm^{-1}$ is to be pointed out particularly. Thus, the microemulsion fuel is distributed clearly better when injected into the combustion chamber as compared to conventional fuel/water mixtures, so that the hydrocarbons are burnt more completely. Consequently, there is a clear increase in efficiency of the combustion as well as reduction of the emission of noxious substances (mainly PM and HC, but also CO).

A further minimization of emissions and improvement of energy yield is caused by the transfer of the water solubilized in the microemulsion from the liquid to the gaseous state, thereby joining the combustion gases in driving the piston of a combustion engine ("steam engine effect").

At the same time, due to the evaporation enthalpy to be employed, reaction heat is dissipated, thus reducing the temperature in the combustion chamber. A significant reduction of noxious substances in the exhaust gases (mainly $NO_x$ and CO, but also HC and PM) is achieved thereby.

Thus, all in all, the total efficiency of the combustion engine is not substantially reduced by using the microemulsion fuels according to the invention despite of a reduction of the combustion temperature.

To eliminate or reduce the emissions of noxious substances, both inorganic and organic additives can be additionally added to the optimum bicontinuous microemulsions.

The microemulsion fuels according to (1) at least consist of an aqueous component, a hydrophobic component and an amphiphilic pseudocomponent. Said aqueous component predominantly consists of water. If required, additives, such as small amounts of salt, glycerol and/or other water-soluble substances may be added to the water. The use of TBA as well as of short-chain alcohols (methanol and ethanol) can be dispensed with. The fuel/water quality (which can be defined, e.g., by the octane number), suppression of undesirable structures (lamellar phase), winterproofness as well as favorable combustion properties can be matched to the different requirements by adding ethanol and methanol. In this connection, the microemulsions according to the invention have substantial advantages over conventional products.

The microemulsions according to embodiment (1) have a volume ratio of oil to water plus oil, $\phi$, of from $\phi$=0.04 to $\phi$=0.99, preferably to $\phi$=0.96, and have a bicontinuous microstructure. Their thermodynamic stability is achieved by a suitable emulsifier or emulsifier mixture. For each oil, there are suitable technical surfactant mixtures of non-ionic and ionic surfactants to obtain temperature-invariant one-phase domains from −30° C. to +95° C., preferably from −30° C. to +70° C., while the formation of disturbing anisotropic and highly viscous structures is suppressed.

For the use of ionic surfactants, it is preferred that the water contains some salt, which is achieved by using combustible inorganic salts, preferably ammonium carbonates, ammonium nitrates etc. At the same time, this results in a reduction of the emission of noxious substances during combustion.

The viscosity of the microemulsion according to (1) is preferably the same as the viscosity of the pure hydrocarbon of the oil component.

The thus obtained mixtures according to (1) are optimized with respect to their emulsifier content. As cosurfactants, longer-chain aliphatic alcohols (e.g., 1-octanol) of group (C-3) and block copolymers (C-4) can be used for enhancing the efficiency. Also, the cosurfactants employed are completely combustible without residues and do not cause any additional emissions of noxious substances during combustion.

The emulsifier mixtures according to the invention consist of inexpensive surfactants which mostly can be prepared from renewable resources. Alternatively, a combination of sugar surfactants with a longer-chain alcohol may also be used.

Short-chain alcohols, preferably ethanol, methanol or propanol, may also be used as components of the aqueous phase. The problem of a high alcohol vapor pressure as in conventional fuels does not occur in a microemulsion according to embodiment (1) when these alcohols are used, because the alcohol becomes enriched at the interface due to its surface activity and therefore does not substantially increase fugacity. A comparison of the vapor pressure curves of water/ethanol mixtures with those of ethanol-containing microemulsions shows that the ethanol vapor pressure above bicontinuous microemulsions is significantly lower.

For each fuel/water mixture according to the invention, there is a specific optimum oil-to-water ratio, which firstly yields the lowest emissions of noxious substances during combustion and which secondly can be burnt most efficiently. By further additives, such as alcohols and organic and/or inorganic additives, the microemulsions can be varied and optimized. According to the invention, the ratio of aqueous to hydrophobic components can be adjusted freely in virtually any mixing ratio due to the particular characteristics of the microemulsion.

The fuels according to the invention which consist of bicontinuous microemulsions have the following advantages over conventional fuels:

- The combustion temperature is reduced.
- The hydrocarbons are burnt more completely.
- The utilization of the heat of combustion for evaporating the water allows an efficient utilization of the energy content of the hydrocarbons, also for low combustion temperatures.
- Due to the reduced combustion temperature, the emissions of noxious substances (CO, $NO_x$, HC, PM) can be significantly reduced.
- The tendency to knocking (detonation) of Otto engines can be reduced. The use of antiknock compounds, such as aromatics or MTBE, can be reduced thereby.
- The use of biodiesel fuel and/or bio-oil is possible despite of its water content.

Over the known fuel/water mixtures, the fuels according to the invention which consist of bicontinuous microemulsions have the following advantages:

- The microemulsion fuels according to the invention are characterized by their thermodynamic stability.
- They are based on optimum microemulsions with a bicontinuous structure which are characterized by minimum amounts of surfactants, have low oil-water interfacial tensions and monodisperse structural quantities, and are electrically conductive.
- Due to the more efficient combustion of bicontinuous microemulsions, raw materials can be saved.
- The content of water or aqueous component can be chosen freely. Thus, the water content can be adjusted to optimum combustion conditions.
- The optimum microemulsions require only small amounts of emulsifiers (<5%) and are thus low-cost.
- The combination of emulsifiers enables temperature-insensitive one-phase microemulsions to be formulated (for example, with a stability range of from −30° C. to +70° C.).
- Short-chain alcohols can be used in microemulsions without causing fugacity problems, because continuous water domains are available.
- Diesel fuel, biodiesel fuel, bio-oil, gasoline, premium gasoline, kerosine and fuel oil can be processed into a bicontinuous microemulsion fuel.
- The combustion of hydrocarbons is effected more completely than with conventional fuel/water mixtures (Ex. 10).
- The microemulsion fuels can be premixed and stored in conventional tanks due to their stability.
- Microemulsion fuels can be readily mixed briefly before combustion.

The invention will be further illustrated by the following Examples which are not intended, however, to limit the subject matter of the invention and the process according to the invention.

EXAMPLES

Example 1

Preparation of Bicontinuous Microemulsions from Components (A(+E)), (B) and (C/D)

In a first step, components (E), if required (for several components (E), each compound individually), were dissolved with stirring in fully desalted water as the first component (A). Subsequently, all further aqueous components (A), such as short-chain alcohols, glycerol etc., were mixed with the solution.

If component (B) consisted of two or more components, these were mixed homogeneously at first. Subsequently, the non-ionic surfactants (C) were added with stirring. Solid surfactants had to be dissolved completely. If necessary, the mixture had to be homogenized by applying heat up to about 60° C. with stirring. Subsequently, if required, the ionic surfactants (D) were added with stirring. Again, solid surfactants had to be dissolved completely. The mixture had to be homogenized anew.

The aqueous component (A(+E)) was added to the oil-surfactant mixture (B+C(/D)). Upon stirring at room temperature, the thermodynamic equilibrium established spontaneously. By applying heat (up to 60° C.), the one-phase microemulsion formed more quickly in some cases.

Example 2

Composition of One-Phase Bicontinuous Microemulsions Consisting of Water, Diesel fuel, Lutensol TO5. AOT and $(NH_4)_2CO_3$ Lutensol® TO5 is a $C_{13}$ oxo alcohol+5 ethylene oxide moieties.

Lutensite® A-BO is the technical grade sodium salt of dioctyl sulfosuccinate (AOT), dissolved in water (concentration about 60% AOT).

K-1:

| | Components: | Proportions in total mixture (in % by weight) Range: | Preferred composition: |
|---|---|---|---|
| A | Water (fully desalted) | 15 to 20 | 17.3 |
| B | Diesel fuel | 70 to 75 | 72.0 |
| C | Lutensol ® TO5 $[C_{12/14}E_5]$ | 5.0 to 9.0 | 7.0 |
| D | AOT | 2.0 to 4.0 | 3.0 |
| E | $(NH_4)_2CO_3$ | 0.6 to 0.8 | 0.7 |

Stable at RT

K-2:

| | Components: | Proportions in total mixture (in % by weight) Range: | Preferred composition: |
|---|---|---|---|
| A | Water (fully desalted) | 15 to 20 | 17.85 |
| B | Diesel fuel | 72 to 78 | 74.4 |
| C | Lutensol ® TO5 $[C_{12/14}E_5]$ | 3.0 to 6.0 | 4.9 |
| D | AOT | 1.0 to 3.0 | 2.1 |
| E | $(NH_4)_2CO_3$ | 0.6 to 0.9 | 0.75 |

Stable at RT

K-10:

| | Components: | Proportions in total mixture (in % by weight) Range: | Preferred composition: |
|---|---|---|---|
| A | Water (fully desalted) | 4 to 12 | 8.46 |
| B | Diesel fuel | 72 to 86 | 79.2 |
| C | Lutensol ® TO5 $[C_{12/14}E_5]$ | 6.7 to 11.0 | 8.0 |
| D | Lutensite ® A-BO [AOT]* | 3.3 to 5.5* | 4.0* |
| E | $(NH_4)_2CO_3$ | 0.15 to 0.6 | 0.34 |

Stable at RT/temperature-invariant (>0° C. to 95° C.)

*Lutensite ® A-BO [AOT + 40% water] ⇒weight proportions based on active substance (AOT), water added to A.

K-11:

| | Components: | Proportions in total mixture (in % by weight) Range: | Preferred composition: |
|---|---|---|---|
| A | Water (fully desalted) | 1.0 to 9.0 | 4.23 |
| B | Diesel fuel | 75 to 93 | 85.5 |
| C | Lutensol ® TO5 $[C_{12/14}E_5]$ | 4.0 to 10.0 | 6.7 |
| D | AOT | 2.0 to 5.0 | 3.3 |
| E | $(NH_4)_2CO_3$ | 0.06 to 0.5 | 0.27 |

Stable at RT/temperature-invariant (>0° C. to 95° C.)

K-12:

| | Components: | Proportions in total mixture (in % by weight) Range: | Preferred composition: |
|---|---|---|---|
| A | Water (fully desalted) | 5.0 to 12.0 | 8.5 |
| B | Diesel fuel | 75 to 87 | 81.0 |
| C | Lutensol ® TO5 $[C_{12/14}E_5]$ | 5.6 to 11.0 | 7.0 |
| D | AOT | 2.4 to 5.0 | 3.0 |
| E | $(NH_4)_2CO_3$ | 0.30 to 0.70 | 0.5 |

Stable at RT

K-13:

| | Components: | Proportions in total mixture (in % by weight) Range: | Preferred composition: |
|---|---|---|---|
| A | Water (fully desalted) | 21 to 31 | 26.14 |
| B | Diesel fuel | 54 to 70 | 63.0 |
| C | Lutensol ® TO5 $[C_{12/14}E_5]$ | 6.3 to 14.0 | 7.0 |
| D | AOT | 2.7 to 6.0 | 3.0 |
| E | $(NH_4)_2CO_3$ | 0.6 to 1.2 | 0.86 |

Stable at RT

K-14:

| | Components: | Proportions in total mixture (in % by weight) Range: | Preferred composition: |
|---|---|---|---|
| A | Water (fully desalted) | 30 to 40 | 35.1 |
| B | Diesel fuel | 48 to 60 | 54.0 |
| C | Lutensol ® TO5 $[C_{12/14}E_5]$ | 6.5 to 14.0 | 7.0 |
| D | AOT | 2.8 to 6.0 | 3.0 |
| E | $(NH_4)_2CO_3$ | 0.7 to 1.3 | 0.90 |

Stable at RT

K-15:

| | Components: | Proportions in total mixture (in % by weight) Range: | Preferred composition: |
|---|---|---|---|
| A | Water (fully desalted) | 40 to 50 | 44.1 |
| B | Diesel fuel | 30 to 50 | 45.0 |
| C | Lutensol ® TO5 [$C_{12/14}E_5$] | 6.8 to 18.0 | 7.0 |
| D | AOT | 2.9 to 8.0 | 3.0 |
| E | $(NH_4)_2CO_3$ | 0.8 to 1.2 | 0.90 |

Stable at RT

Summary Example 2:

| | Components: | Proportions in total mixture (in % by weight) Range: | Preferred composition: |
|---|---|---|---|
| A | Water (fully desalted) | 1 to 50 | |
| B | Diesel fuel | 30 to 93 | |
| C | Lutensol ® TO5 [$C_{12/14}E_5$] | 3 to 18.0 | |
| D | AOT | 1 to 8.0 | |
| E | $(NH_4)_2CO_3$ | 0.06 to 1.3 | |

Stable at RT, partially temperature-invariant

Example 3

Composition of Microemulsions Consisting of Water, Diesel Fuel, Lutensol TO5, Oleic Acid, Dodecylamine and Ammonium Carbonate

K-4:

| | Components: | Proportions in total mixture (in % by weight) Range: | Preferred composition: |
|---|---|---|---|
| A | Water (fully desalted) | 5 to 15 | 9.22 |
| B | Diesel fuel | 80 to 92 | 86.4 |
| C | Lutensol ® TO5 [$C_{12/14}E_5$] | 2.2 to 5.5 | 3.0 |
| D | Oleic acid | 0.45 to 1.1 | 0.6 |
| | Dodecylamine | 0.3 to 0.8 | 0.4 |
| E | $(NH_4)_2CO_3$ | 0.15 to 0.6 | 0.38 |

Stable at RT

K-5:

| | Components: | Proportions in total mixture (in % by weight) Range: | Preferred composition: |
|---|---|---|---|
| A | Water (fully desalted) | 14 to 24 | 18.43 |
| B | Diesel fuel | 70 to 82 | 76.8 |

-continued

K-5:

| | Components: | Proportions in total mixture (in % by weight) Range: | Preferred composition: |
|---|---|---|---|
| C | Lutensol ® TO5 [$C_{12/14}E_5$] | 2.2 to 5.0 | 3.0 |
| D | Oleic acid | 0.45 to 1.2 | 0.6 |
| | Dodecylamine | 0.3 to 1.0 | 0.4 |
| E | $(NH_4)_2CO_3$ | 0.4 to 1.2 | 0.77 |

Stable at RT

K-6:

| | Components: | Proportions in total mixture (in % by weight) Range: | Preferred composition: |
|---|---|---|---|
| A | Water (fully desalted) | 5 to 15 | 9.02 |
| B | Diesel fuel | 79 to 91 | 84.8 |
| C | Lutensol ® TO5 [$C_{12/14}E_5$] | 4.0 to 7.2 | 4.8 |
| D | Oleic acid | 0.6 to 1.1 | 0.72 |
| | Dodecylamine | 0.4 to 0.8 | 0.48 |
| E | $(NH_4)_2CO_3$ | 0.15 to 0.6 | 0.38 |

Stable at 50° C.

Summary Example 3:

| | Components: | Proportions in total mixture (in % by weight) Range: | Preferred composition: |
|---|---|---|---|
| A | Water (fully desalted) | 5 to 24 | |
| B | Diesel fuel | 70 to 92 | |
| C | Lutensol ® TO5 [$C_{12/14}E_5$] | 2.2 to 7.2 | |
| D | Oleic acid | 0.45 to 1.2 | |
| | Dodecylamine | 0.3 to 1 | |
| E | $(NH_4)_2CO_3$ | 0.15 to 1.2 | |

Stable at RT or 50° C.

Example 4

Composition of Microemulsions Consisting of Water (Optionally+Ethanol), Diesel Fuel, Lutensol XL 80, Sorbitan Monooleate Lutensol XL® 80 is a decanol alkoxylate with about 8 ethylene oxide moieties based on a C10 Guerbet alcohol.

K-7:

| | Components: | Proportions in total mixture (in % by weight) Range: | Preferred composition: |
|---|---|---|---|
| A | Water (fully desalted) | 45 to 55 | 50.0 |
| B | Diesel fuel | 37 to 47 | 42.0 |

-continued

K-7:

| | Components: | Proportions in total mixture (in % by weight) Range: | Preferred composition: |
|---|---|---|---|
| C | Lutensol ® XL 80 [$C_{10(branched)}E_8$] | 4.2 to 6.0 | 4.8 |
| | Sorbitan monooleate | 2.8 to 4.0 | 3.2 |
| D | | | |
| E | | | |

Stable at 55° C.

K-8:

| | Components: | Proportions in total mixture (in % by weight) Range: | Preferred composition: |
|---|---|---|---|
| A | Water (fully desalted) | 39 to 49 | 44.0 |
| | Ethanol | 2.0 to 2.6 | 2.3 |
| B | Diesel fuel | 34 to 44 | 38.7 |
| C | Lutensol ® XL 80 [$C_{10(branched)}E_8$] | 7.8 to 10.5 | 9.0 |
| | Sorbitan monooleate | 5.2 to 7.0 | 6.0 |
| D | | | |
| E | | | |

Stable at 55° C.

K-9:

| | Components: | Proportions in total mixture (in % by weight) Range: | Preferred composition: |
|---|---|---|---|
| A | Water (fully desalted) | 39 to 49 | 39.4 |
| | Ethanol | 6.4 to 7.4 | 6.9 |
| B | Diesel fuel | 34 to 44 | 38.7 |
| C | Lutensol ® XL 80 [$C_{10(branched)}E_8$] | 6.0 to 9.0 | 7.4 |
| | Sorbitan monooleate | 6.0 to 9.0 | 7.6 |
| D | | | |
| E | | | |

Stable at 55° C.

Summary Example 4:

| | Components: | Proportions in total mixture (in % by weight) Range: | Preferred composition: |
|---|---|---|---|
| A | Water (fully desalted) | 39 to 55 (+ EtOH: to 49) | |
| | Ethanol | 2.0 to 7.4 | |
| B | Diesel fuel | 34 to 47 | |
| C | Lutensol ® XL 80 [$C_{10(branched)}E_8$] | 4.2 to 10.5 | |
| | Sorbitan monooleate | 2.8 to 9.0 | |
| D | | | |
| E | | | |

Stable at 55° C.

Example 5

Composition of Microemulsions Consisting of Water, Diesel Fuel, Lutensol TO5, AOT, NaCl (+Urea)

K-16:

| | Components: | Proportions in total mixture (in % by weight) Range: | Preferred composition: |
|---|---|---|---|
| A | Water (fully desalted) | 4 to 12 | 8.62 |
| B | Diesel fuel | 70 to 86 | 79.2 |
| C | Lutensol ® TO5 [$C_{12/14}E_5$] | 6.7 to 12.0 | 8.0 |
| D | Lutensite ® A-BO [AOT]* | 3.3 to 6.0* | 4.0* |
| E | NaCl | 0.08 to 0.30 | 0.18 |

Stable at RT/temperature-invariant (>0° C. to 95° C.)

*Lutensite ® A-BO [AOT + 40% water] ⇒weight proportions based on active substance (AOT), water added to A.

K-19:

| | Components: | Proportions in total mixture (in % by weight) Range: | Preferred composition: |
|---|---|---|---|
| A | Water (fully desalted) | 45.0 to 55.0 | 49.6 |
| B | Diesel fuel | 37.0 to 47.0 | 41.9 |
| C | Lutensol ® TO5 [$C_{12/14}E_5$] | 3.5 to 7.8 | 3.9 |
| D | AOT | 3.5 to 8.2 | 4.1 |
| E | NaCl | 0.15 to 1.25 | 0.5 |

Stable at RT

K-18:

| | Components: | Proportions in total mixture (in % by weight) Range: | Preferred composition: |
|---|---|---|---|
| A | Water (fully desalted) | 6.0 to 10.0 | 8.31 |
| B | Diesel fuel | 75 to 85 | 78.4 |
| C | Lutensol ® TO5 [$C_{12/14}E_5$] | 8.0 to 12.0 | 8.6 |
| D | Lutensite ® A-BO [AOT]* | 4.0 to 6.0* | 4.3* |
| E | NaCl | 0.15 to 0.25 | 0.22 |
| | Urea | 0.12 to 0.20 | 0.17 |

Stable at RT/temperature-invariant (>0° C. to 95° C.)

*Lutensite ® A-BO [AOT + 40% water] ⇒weight proportions based on active substance (AOT), water added to A.

Example 6

Composition of Microemulsions Consisting of Water, Diesel Fuel, Lutensol TO5, AOT, Ammonium Acetate Lutensol® TO6 is a $C_{13}$ oxo alcohol+6 ethylene oxide moieties.

K-17:

| | Components: | Proportions in total mixture (in % by weight) Range: | Preferred composition: |
|---|---|---|---|
| A | Water (fully desalted) | 4 to 12.5 | 8.51 |
| B | Diesel fuel | 68 to 86 | 78.4 |
| C | Lutensol ® TO5 [$C_{12/14}E_5$] | 6.7 to 12.0 | 8.6 |
| D | Lutensite ® A-BO [AOT]* | 3.3 to 6.0* | 4.3* |
| E | $NH_4$ acetate | 0.09 to 0.40 | 0.19 |

Stable at RT/temperature-invariant (>0° C. to 95° C.)

*Lutensite ® A-BO [AOT + 40% water] ⇒weight proportions based on active substance (AOT), water added to A.

Example 7

Composition of Microemulsions Consisting of Water, Diesel Fuel, Lutensol TO5, Ammonium Oleate, Ammonium Acetate

K-3:

| | Components: | Proportions in total mixture (in % by weight) Range: | Preferred composition: |
|---|---|---|---|
| A | Water (fully desalted) | 40 to 60 | 47.53 |
| B | Diesel fuel | 40 to 60 | 48.5 |
| C | Lutensol ® TO6 [$C_{12/14}E_6$] | 1.5 to 2.5 | 1.5 |
| D | Ammonium oleate | 1.0 to 2.5 | 1.5 |
| E | $NH_4$ acetate | 0.6 to 1.6 | 0.97 |

Stable at RT

Example 8

Composition of Microemulsions Consisting of Water, Diesel Fuel, Lutensol TO5 and TO3

Lutensol® TO3 is a $C_{13}$ oxo alcohol+3 ethylene oxide moieties.

K-20:

| | Components: | Proportions in total mixture (in % by weight) Range: | Preferred composition: |
|---|---|---|---|
| A | Water (fully desalted) | 40 to 52 | 46.0 |
| B | Diesel fuel | 40 to 52 | 46.0 |

-continued

K-20:

| | Components: | Proportions in total mixture (in % by weight) Range: | Preferred composition: |
|---|---|---|---|
| C | Lutensol ® TO5 [$C_{12/14}E_5$] | 3.0 to 8.0 | 4.0 |
| | Lutensol ® TO3 [$C_{12/14}E_3$] | 3.0 to 8.0 | 4.0 |
| D | | | |
| E | | | |

Stable at RT

Example 9

Measurements on Engine Test Benches

A) Test bench I: The first combustion measurements were performed on an engine test bench of the University of Duisburg. A Hatz (diesel) engine was employed. The measurement was performed at a constant revolutions per minute of 1500 $min^{-1}$. Through a brake, the load and thus the power was adjusted. The measurement was performed for two loads, at 14.0 Nm (2.20 kWh) and at 9.6 Nm (1.51 kWh). In addition to the microemulsion, a reference fuel (diesel fuel) was burnt for direct comparison. The consumption was established by a fuel balance. In addition to the exhaust gas temperature, the noxious substances $NO_x$, CO, HC and PM as well as $O_2$ and CO were measured in the exhaust gas. For the particulate matter, the Bosch number on the one hand and the particle size distribution on the other hand were determined by a differential mobility analyzer.

The mixture of components K-1 was employed.

B) Test bench II: Further combustion experiments were performed on an engine test bench of I.S.P. of Salzbergen. In this case, a VW TDI (turbo diesel) engine was employed. As a reference fuel, a standard diesel fuel was employed. The fuel consumption was established by a fuel balance by analogy with the MWEG cycle (EU Direction 93/116/EC). In addition and by analogy with test bench I, a partial load stage (N=2500 $min^{-1}$/torque=75 Nm) as well as two full load stages (N=1900 $min^{-1}$ and N=4000 $min^{-1}$) were initiated in order to measure the exhaust gas temperatures and the noxious substances particulate matter (smoke values) and $NO_x$, as well as the maximum power for the full load stages. In the partial load stage, the fuel consumption was also established.

In these measurements, the water content was varied from 0 to 8.7% and from 9 to 27%. The following mixtures of components were used (derived from K-12 and K-10):

(A) was water in all mixtures, (B) was diesel fuel in all mixtures employed, (C) was Lutensol TO5 in all mixtures employed, (E) was ammonium carbonate in all mixtures. (D) was either pure AOT or Lutensite® A-BO, where in the latter case, for calculating the AOT content and water content, the water content of Lutensite® A-BO was subtracted and added to (A).

| (A) in % by weight | (C/D) content γ | (E) content ϵ, based on (A + E) | (D) | (D) content δ, based on (C + D) |
|---|---|---|---|---|
| 9 | 0.1 | 0.055 | AOT | 0.3 |
| 18 | 0.1 | 0.040 | AOT | 0.3 |
| 27 | 0.1 | 0.32 | AOT | 0.3 |
| 8.7 | 0.13 | 0.038 | Lutensite ® A-BO | 0.335 |

-continued

| (A) in % by weight | (C/D) content γ | (E) content ε, based on (A + E) | (D) | (D) content δ, based on (C + D) |
|---|---|---|---|---|
| 4.35 | 0.13 | 0 | Lutensite ® A-BO | 0.335 |
| 2.87 | 0.13 | 0 | Lutensite ® A-BO | 0.335 |
| 2.25 | 0.10 | 0 | Lutensite ® A-BO | 0.335 |

Example 10

Results of Measurements on Engine Test Benches

A) Test bench I: The measuring results are shown in FIG. 3. The first combustion measurements already showed clear improvements in the microemulsion over the reference diesel fuel, even though this was not yet the best suited microemulsion. Thus, the exhaust gas temperature decreased by 50 K for the lower and by 100 K for the higher load as compared to the reference diesel fuel. The fuel consumption and the efficiency, based on the combustible fractions (without water), were almost identical. Within the scope of the measuring error, the microemulsion even had a slightly better efficiency. The exhaust gas emissions were reduced by the microemulsion as compared to the reference diesel fuel. Thus, NO, was reduced by up to 26%, and CO by up to 32%. The Bosch number (particulate matter) became lower by up to 37%, the measurable particles becoming smaller and their number higher.

B) Test bench II: The measuring results are shown in FIG. 4. The first combustion experiments with variation of the water content showed improvements when microemulsions were used as compared to the reference diesel fuel. It was observed that the exhaust gas temperature decreased linearly as the water content decreased. The fuel consumption and the efficiency, based on the combustible components, remained the same here, like in Example 10A. In this case too, like in Example 10A, slight reductions of the fuel consumption within the measuring error could be seen. Measurements made at even higher water contents even indicated an increase of efficiency. For low water contents, no change of the $NO_x$ emission as compared to the reference diesel fuel could be observed. In contrast, for higher water contents, the $NO_x$ emission was decreased by about 10%. Already for lower water contents, the measurable particulate matter was reduced drastically, in part to below the detection limit. Thus, about 85% less particulate matter was measured already for low water concentrations.

The invention claimed is:

1. A thermodynamically stable bicontinuous one-phase microemulsion comprising an aqueous component (A), a hydrophobic component (B), an amphiphilic component (C/D) and, optionally, one or more members selected from the group consisting of salts and additives (E), wherein said microemulsion is a nanostructured mixture simultaneously comprising a continuous aqueous phase and a continuous hydrophobic phase separated from each other by an amphiphilic film on a microscopic level, said microemulsion has an interfacial tension range between $10^{-1}$ and $10^{-4}$ mN/M, and the hydrophobic component (B) contains:

(i) at least one mineral oil-based fuel; and/or (ii) at least one fuel based on vegetable oils or their derivatives.

2. The microemulsion according to claim 1, wherein said aqueous component (A)

(i) is selected from water and alcohol-water mixtures; and/or (ii) contains from 10 to 100% by weight of water; and/or (iii) contains additional salts and additives (E) selected from the group consisting of alkali halides, ammonium halides, ammonium salts or organic acids and urea derivatives, the additives (E) being present in concentrations of from 0 to 4% by weight, based on the total microemulsion.

3. The microemulsion according to claim 1, wherein said hydrophobic component (B) contains diesel fuel as a component.

4. The microemulsion according to claim 1:

(i) which is electrically conductive and/or temperature-stable; and/or (ii) in which the proportion of amphiphilic component (C/D) is from 0.5 to 20% by weight; and/or (iii) in which the proportion of aqueous component (A) is from 0.5 to 65% by weight; and/or (iv) in which the proportion of hydrophobic component (B) is from 4 to 99% by weight.

5. The microemulsion according to claim 1, wherein said amphiphilic component (C/D) contains at least one non-ionic surfactant (C).

6. The microemulsion according to claim 5, wherein said amphiphilic component (C/D) additionally contains at least (i) an ionic surfactant (D); and/or (ii) a cosurfactant (C-3); and/or (iii) an efficiency booster (C-4) selected from amphiphilic block copolymers.

7. The microemulsion according to claim 5, wherein said amphiphilic component (C/D) contains at least, in addition to a linear or branched surfactant (C-1):

(i) an ionic surfactant (D); and/or (ii) a sugar surfactant (C-2); and/or (iii) an alcohol; and (iv) the proportion of component (C) comprising components from the groups linear or branched surfactants (C-1), surfactants with a core structure (C-2), cosurfactants (C-3) and efficiency boosters (C-4) selected from amphiphilic block copolymers, based on the amphiphilic component (C/D), is from 50 to 100% by weight; and/or (iv) the proportion of component (C-2), based on the total amount of component (C), is from 0 to 85% by weight.

8. The microemulsion according to claim 1, wherein component (A) is water or a water-ethanol mixture, component (B) is diesel fuel, component (C) comprises at least one polyethoxylated long-chain alcohol, and wherein the proportion of (C) in the microemulsion is from 1 to 10% by weight.

9. The microemulsion according to claim 8, wherein (A) is water, (C) is a polyethoxylated $C_{13}$ oxo alcohol ($C_{12/14}E_5$), and (E) is ammonium carbonate, and optionally:

(i) (D) is AOT; and/or (ii) (D) is a mixture of oleic acid and dodecylamine.

10. The microemulsion according to claim 8, wherein (C) is a polyethoxylated decanol ($C_{10}E_8$) in combination with sorbitan monooleate, and optionally:

(i) the following proportions of the components are present: (A) from 39 to 55% by weight; (B) from 34 to 47% by weight; (C) $C_{10}E_8$ from 4.2 to 10.5% by weight and sorbitan monooleate from 2.8 to 9% by weight; and/or (ii) (A) contains ethanol, and the ethanol content in the microemulsion is from 2.0 to 7.4% by weight.

11. The microemulsion according to claim 8, wherein (A) is water, (C) is a polyethoxylated $C_{13}$ oxo alcohol ($C_{12/14}E_5$), (D) is AOT, and optionally:

(i) (E) is sodium chloride; and/or (ii) (E) is sodium chloride and urea; and/or (iii) (E) is ammonium acetate.

12. The microemulsion according to claim 8, wherein (A) is water, (C) is a polyethoxylated $C_{13}$ oxo alcohol ($C_{12/14}E_6$), (D) is ammonium oleate, and (E) is ammonium acetate, and optionally the following proportions of the components are present: (A) from 40 to 60% by weight; (B) from 40 to 60% by weight; (C) from 1.5 to 2.5% by weight; (D) from 1.5 to 2.5% by weight; and (E) from 0.6 to 1.6% by weight.

13. The microemulsion according to claim 8, wherein (A) is water, (C) is a polyethoxylated $C_{13}$ oxo alcohol ($C_{12/14}E_5$) and a further polyethoxylated alcohol, and optionally the following proportions of the components are present: (A) from 40 to 52% by weight; (B) from 40 to 52% by weight; (C) from 3.0 to 8.0% for each individual component.

14. The microemulsion according to claim 1, which is a fuel.

15. A method for the determination and optimization of microemulsions according to claim 1, comprising the steps of:

(i) determining the temperature variance and adjusting the temperature invariance of the one-phase microemulsion by adjusting the content of amphiphilic component (C/D); and (ii) adjusting the water-to-oil ratio within a range of the volume ratio of oil to water plus oil of from 4 to 99% by volume of the hydrophobic component (B).

16. A fuel comprising a microemulsion according to claim 1.

17. An explosive comprising a microemulsion according to claim 1.

* * * * *